US010124333B2

(12) United States Patent
Bhargava et al.

(10) Patent No.: US 10,124,333 B2
(45) Date of Patent: Nov. 13, 2018

(54) DISCRETE ELEMENTS FOR 3D MICROFLUIDICS

(71) Applicants: UNIVERSITY OF SOUTHERN CALIFORNIA, Los Angeles, CA (US); REOLAB INC., Mountain View, CA (US)

(72) Inventors: Krisna Chandra Bhargava, San Jose, CA (US); Bryant Thompson, Miramar, FL (US); Noah Malmstadt, Altadena, CA (US)

(73) Assignees: REOLAB INC., Mountain View, CA (US); UNIVERSITY OF SOUTHERN CALIFORNIA, Los Angeles, CA (US)

( * ) Notice: Subject to any disclaimer, the term of this patent is extended or adjusted under 35 U.S.C. 154(b) by 505 days.

(21) Appl. No.: 14/735,941

(22) Filed: Jun. 10, 2015

(65) Prior Publication Data

US 2015/0352550 A1 Dec. 10, 2015

Related U.S. Application Data

(60) Provisional application No. 62/010,107, filed on Jun. 10, 2014.

(51) Int. Cl.
*B01L 3/00* (2006.01)

(52) U.S. Cl.
CPC ... *B01L 3/502715* (2013.01); *B01L 3/502707* (2013.01); *B01L 3/502746* (2013.01);
(Continued)

(58) Field of Classification Search
CPC ..... B01L 2300/087; B01L 2300/0874; B01L 2200/028; B01L 3/502715;
(Continued)

(56) References Cited

U.S. PATENT DOCUMENTS 5,495,105 A * 2/1996 Nishimura ..... H05H 3/04 250/222.2
6,174,670 B1 1/2001 Witter et al.
(Continued)

OTHER PUBLICATIONS

*Biofire Defense, LLC a Delaware limited liability company and University of Utah Reasearch Foundation, a Utah non-profit corporation* v. *Fluidigm Corporation, a Delaware corporation*. Case No: 2:16-cv-00430-DBP, May 23, 2016.
(Continued)

*Primary Examiner* — Lyle Alexander
*Assistant Examiner* — Bryan Kilpatrick
(74) *Attorney, Agent, or Firm* — Polsinelli LLP

(57) ABSTRACT

A module may be provided with at least one opening, the opening being an endpoint of a microfluidic channel that passes through at least part of the module. A set of multiple such modules may be arranged into an arrangement of modules, which may be coupled together using one or more coupling mechanisms included on each module. The arrangement of modules may fit within a regular polyhedral grid, and each module within the arrangement of modules may have a form suitable for arrangement of the modules within the regular polyhedral grid. Fluid may then flow through at least a subset of the arrangement of modules via the microfluidic channel of each module of the subset of the arrangement of modules. Some modules may include sensors, actuators, or inner microfluidic channel surface coatings. The arrangement of modules may form a microfluidic circuit that can perform a microfluidic circuit function.

21 Claims, 21 Drawing Sheets

(52) U.S. Cl.
CPC . *B01L 2200/028* (2013.01); *B01L 2200/0605* (2013.01); *B01L 2200/0647* (2013.01); *B01L 2200/0684* (2013.01); *B01L 2200/0689* (2013.01); *B01L 2200/0694* (2013.01); *B01L 2200/10* (2013.01); *B01L 2300/021* (2013.01); *B01L 2300/0654* (2013.01); *B01L 2300/0663* (2013.01); *B01L 2300/0864* (2013.01); *B01L 2300/0867* (2013.01); *B01L 2300/0874* (2013.01); *B01L 2300/161* (2013.01); *B01L 2400/043* (2013.01); *B01L 2400/0666* (2013.01); *Y10T 436/2575* (2015.01)

(58) Field of Classification Search
CPC ..... B01L 2300/0877; B01L 2200/025; B01L 2200/027; B01L 2200/10; B01L 3/5027; B01L 2300/041; B01L 3/502707; B01L 3/502746; B01L 2200/06; Y10T 436/2575
See application file for complete search history.

(56) References Cited

U.S. PATENT DOCUMENTS

| | | | | |
|---|---|---|---|---|
| 7,670,832 | B2 | 3/2010 | Wittwer et al. | |
| 2002/0124896 | A1* | 9/2002 | O'Connor | B01F 5/064 137/833 |
| 2004/0037739 | A1 | 2/2004 | McNeeley et al. | |
| 2004/0206410 | A1 | 10/2004 | Extrand | |
| 2005/0045479 | A1 | 3/2005 | Weigl et al. | |
| 2006/0281090 | A1 | 12/2006 | Lieberet | |
| 2008/0003142 | A1* | 1/2008 | Link | B01F 3/0807 422/82.08 |
| 2010/0307616 | A1 | 12/2010 | Liou et al. | |
| 2011/0177530 | A1 | 7/2011 | Corcoran et al. | |

OTHER PUBLICATIONS

Van De Pol et al., F.C.M.; "A Thermo-Pneumatic Actuation Principle for a Microminature Pump and Other Micromechanical Devices", Sensors and Actuators, 17 (1989), pp. 139-143.
Van De Pol et al., F.C.M.; "A Thermopneumatic Micropump Based on Micro-Engineering Techniques", Sensors and Actuators, A21-A23 (1990), pp. 198-202.
Van Lintel et al., H.T.G; "A Piezoelectric Micropump Based on Micromachining Silicon", Sensors and Actuators, 15 (1988) 153-167. Mar. 17, 1988.
Velve Casquillas et al., G.; "Thermo-resistance based microcalorimeter for continuous chemical enthalpy measurements", Microelectronic Engineering, vol. 85, pp. 1367-1369, Jan. 15, 2008.
Walczak et al., Rafal; "Inkjet 3D printing of microfluidic structures-on the selection of the printer towards printing your own microfluidic chips", Journal of Micromechanics and Microengineering, vol. 25, 2015.
Wang et al., Li; "Demonstration of MEMS-based differential scanning calorimetry for determining thermodynamic properties of biomolecules", Sensors and Actuators B: Chemical, Jul. 22, 2008.
Whitesides, George M.; "The origins and the future of Microfluidics", Nature, vol. 442, Jul. 27, 2006.
Yang et al., Mengsu; "Generation of concentration gradient by controlled flow distrubution and diffusive mixing in a microfluidic chip", Lab On a Chip, 2002, 2, pp. 158-163.
Yuen, Po Ki; "SmartBuild—A truly plug-n-play modular microfluidic system", Lab On A Chip, vol. 8, pp. 1374-1378, Jul. 3, 2008.
Zhang et al., Yuyan; "Calorimetric biosensors with integrated microfluidic channels", Biosensors and Bioelectronics, vol. 19 (2004) pp. 1733-1743.
Zhao et al., Xiao-Mei; "Fabrication of Three-Dimensional Micro-Structures: Microtransfer Molding", Advanced Material, vol. 8, No. 10, 1996.
Zhu et al., Feng; "Three-dimensional printed millifluidic devices for Zebrafish embryo tests", Biomicrofluidics, vol. 9, 2015.
Alapan et al, Yunus; "3D Printing Based Hybrid Manufacturing of Microfluidic Devices", Journal of Nanotechnology in Engineering and Medicine, Aug. 6, 2015.
Alapan et al, Yunus; "Three-Dimensional Printing Based Hybrid Manufacturing of Microfluidic Devices", Journal of Nanotechnology in Engineering and Medicine, vol. 6, May 2015.
Anderson et al, Kari B.; "A 3D Printed Fluidic Device that Enables Integrated Features", Analytical Chemistry, May 21, 2013.
Au et al., Anthony K.; "3D-printed microfluidic automation", Lab On A Chip, vol. 15, pp. 1934-1941, 2015.
et al., Anthony K.; "Mail-order microfluidics: evaluation of stereolithography for the production of microfluidic devices", Lab On A Chip, vol. 14, pp. 1294-1301, Jan. 23, 2014.
Auroux et al., Pierre-Alain; "Micro Total Analysis Systems. 2. Analytical Standard Operations and Applications", Analytical Chemistry, vol. 74, No. 12, Jun. 15, 2002.
Bajorath, Jurgen; "Integration of Virtual and High-Throughput Screening", Nature Reviews Drug Discovery, vol. 1, Nov. 2002, pp. 882-894.
Bataillard et al., P.; "An integrated silicon thermopile as biosensor for the thermal monitoring of glucose, urea and penicillin", Biosensors & Bioelectronics 8 (1993), pp. 89-98.
Becker et al., Holger; "Polymer Microfluidic Devices", Talanta, vol. 56 (2002), pp. 267-287.
Beebe et al., David J.; "Physics and Applications of Microfluidics in Biology", Annu. Rev. Biomed. Eng. 2002. 4:261-286.
Bennett et al., Mathieu A.; "Optically trapped microsensors for microfluidic temperature measurement by fluorescence lifetime imaging microscopy", Lab On A Chip, vol. 11, pp. 3821-3828, Aug. 31, 2011.
Bhargava et al., Krisna C.; "Discrete elements for 3D microfluidics", Proceedings of the National Academy of Sciences, vol. 11, No. 42, Oct. 21, 2014.
Bishop et al., Gregory W.; "3D-Printed Fluidic Devices for Nanoparticle Preparation and Flow-Injection Amerometry Using Integrated Prussian Blue Nanoparticle-Modified Electrodes", Analytical Chemistry, vol. 87, pp. 5437-5443, Apr. 22, 2015.
Bleicher et al., Konrad H.; "Hit and Lead Generation: Beyond High-Throughput Screening", Nature Review | Drug Discover, vol. 2, May 2003, pp. 369-378.
Brennan et al., Martin D.; "A 3D-Printed Oxygen Control Insert for a 24-well Plate", PLOS ONE, Sep. 11, 2015.
Brouzes et al., Eric; "Droplet microfluidic technology for single-cell high-throughput screening", Proceedings of the National Academy of Sciences, vol. 106, No. 34, Aug. 25, 2009.
Burbaum, Jonathan J.; Sigal, Nolan H.; "New technologies for high-throughput screening", Current Opinion in Microbiology, 1997, 1:72-78.
Burger et al., J.; "IR thermocycler for centrifugal microfluidic platform with direct on-disk wireless temperature measurement system", 2011 16th International Solid-State Sensors, Actuators and Microsystems Conference, 2011.
Burns et al., Mark A.; "An Integrated Nanoliter DNA Analysis Device", Science, vol. 282, Oct. 16, 1998.
Bustillo et al., James M.; "Surface Micromachining for Microelectromechanical Systems", Proceedings of the IEEE, vol. 86, No. 8, Aug. 1998.
Chaudhari et al., Ajit M.; "Transient Liquid Crystal Thermometry of Microfabricated PCR Vessel Arrays", Journal of Microeletromechanical Systems, vol. 7, No. 4, Dec. 1998.
Choi et al., Sungyoung; "Microfluidic parallel circuit for measurement of hydraulic resistance", Biomicrofluidics, vol. 4, 2010.
Choong et al, Kim; "A Serial Dilution microfluidic device using a ladder network generating logartithmic or linear concentrations", Lab On A Chip, vol. 8, pp. 473-479, Feb. 1, 2008.
Comina et al, German; "PDMS lab-on-a-chip fabrication using 3D printed templates", Lab On A Chip, vol. 14, pp. 424-430, 2014.
Dertinger et al., Stephen K.W.; "Generation of Gradients Having Complex Shapes Using Microfluidic Networks", Analytical Chemistry, vol. 73, No. 6, Mar. 15, 2001.
de Wildt et al., Ruud M.T.; "Antibody arrays for high-throughput screening of antibody—antigen interactions", Nature Biotechnology, vol. 18, Sep. 2000.

(56) References Cited

OTHER PUBLICATIONS

Erkal et al., Jayda L.; "3D printed microfluidic devices with integrated versatile and reusuable electrodes", Lab On A Chip, vol. 14, pp. 2023-2032, 2014.
Ernst et al., Herbert; "Dynamic Thermal Sensor-Principles in MEMS for Fluid Characterization", IEEE Sensors Journal, vol. 1, No. 4, Dec. 2001.
Esashi, Masayosi; "Integrated Micro Flow Control Systems", Sensors and Actuators, A21-A23 (1990), pp. 161-137.
Esashi, Masayosi; "Normally Close Microvalve and Micropump Fabricated on a Silicon Wafer", IEEE Micro Electro Mechanical Systems, an Investigation of Micro Structures, An Investigation of Micro Structures, Sensors Actuators,1989.
Feynman, Richard P.; "There's Plenty of Room at the Bottom", Caltech Engineering and Science. vol. 23:5, Feb. 1960.
Fuerstman et al., Michael J; "Solving Mazes Using Microfluidic Networks", Langmuir, vol. 19, No. 11, 2003, pp. 4714-4722.
Furjes et al., P.; "Thermal Characterisation of a direction dependent flow sensor", Sensors and Actuators, 115 (2004), pp. 417-423.
Gelber et al., Matthew K.; "Monolithic multilayer microfluidics via sacrificial molding of 3D-printed isomalt", Lab On A Chip, vol. 15, pp. 1736-1741, 2015.
Gravesen et al., Peter; "Microfluidics—A Review", Journal of Micromechanics and Microengineering, vol. 3, No. 4. (1993) pp. 168-182.
Grodzinkski et al., P.; "BioMEMs and BioMedical Nanotechnology: A Modular Microfluidic System for Cell Pre-concentration and Genetic Sample Preparation", Biomedical Microdevices vol. 5, No. 4 pp. 303-310, 2003.
Guckenberger et al., David J.; "Micromilling: a method for ultra-rapid prototyping of plastic microfluidic devices", Lab On A Chip, vol. 15, pp. 2364-2378, 2015.
Hany et al., Cindy; "A millifluidic calorimeter with infrared thermography for the measurement of chemical reaction enthlpy and kinetics", Quantitative InfraRed Thermograghy Journal, vol. 5, No. 2, pp. 211-229, (2008).
Hany et al., Cindy; "Thermal analysis of chemical reaction with continuous microfluidic calorimeter", Chemical Engineering Journal, vol. 160, pp. 814-822, Feb. 24, 2010.
Ho et al., Chee Meng Benjamin; "3D printed microfluidics for biological applications", Lab On A Chip, vol. 15, pp. 3627-3637, 2015.
Hoang et al., Viet N.; "Dynamic temperature measurement in microfluidic devices using thermochromic liquid crystal", Lab on a Chip, vol. 8, pp. 484-487, Jan. 18, 2008.
Hu et al., Jie-Bi; "A compact 3D-printed interface for coupling open digital microchips with Venturi easy ambient sonic-spray ionization mass spectrometry", Analyst, vol. 140, Jan. 14, 2015.
Inglese et al., James; Quantitive high-throughput screening: A titration-based approach that efficiently identifies biological activities in large chemical libraries, Proceedings of the National Academy of Sciences of the United States of America, vol. 103, No. 31, pp. 11473-11478, Aug. 1, 2006.
Irimia et al., Daniel; "Universal Microfluidic Gradient Generator", Analytical Chemistry, vol. 78, No. 10, pp. 3472-3477, May 15, 2006.
Jacobson et al., Stephen C.; "Microfluidic Devices for Electrokinetically Driven Parallel and Serial Mixing", Anlytical Chemistry, vol. 71, No. 20, pp. 4455-4459, Oct. 15, 1999.
Kilby, Jack S.; "Invention of the Integrated Circuit", IEEE Transactions on Electron Devices, vol. ED-23, No. 7, Jul. 1976.
Kim et al., Enoch; "Polymer microstructures formed by moulding in capillaries", Department of Chemistry, Nature, vol. 376, Aug. 17, 1995.
Kitson et al, Philip J.; "Configurable 3D-Printed millifluidic and microfluidic 'lab on a chip' reactionware devices", Lab On A Chip, vol. 12, No. 18, Sep. 21, 2012.
Kovacs et al., Gregory T.A.; "Bulk Micromachining of Silicon", Proceedings of the IEEE, vol. 86, No. 8, Aug. 1998.
Kwak et al., B.S.; "Dual thermopile integrated microfluidic calorimeter for biochemical thermodynamics", Microfluid Nanofluid, vol. 5, pp. 255-262, (2008).
Langelier et al., Sean M.; "Flexible casting of modular self-aligning microfluidic assembly blocks", Lab On A Chip, vol. 11, pp. 1679-1687, Feb. 10, 2011.
Lee et al, Do-Hyun; "User-friendly 3D bioassays with cell-containing hydrogel modules: Narrowing the gap between microfluidc bioassays and clinical end-users' needs", Lab On A Chip, Vold. 15, pp. 2379-2387, 2015.
Lee et al., Kangsun; "Microfluidic network-based combinatorial dilution device for high throughput screening and optimization", Microfluidics and Nanofluidics, vol. 8, pp. 677-685, 2010.
Lee et al., Kyoung G.; "3D printed modules for integrated microfluidic devices", RSC Advances, vol. 4, pp. 32876-32880, 2014.
Lee et al., Wanjae; "3D-Printed Microfluidic Devices for the Detection of Pathogenic Bacteria Using Size-based Separation in Helical Channel with Trapezoid Cross-Section", Scientific Reports, vol. 5, Jan. 12, 2015.
Lee et al., Wonhee; "High-sensitivity microfluidic calorimeters for biological and chemical applications", Proceedings of the National Academy of Sciences, vol. 106, No. 36, Sep. 8, 2009.
Lerchner et al., J.; "A new micro-fluid chip calorimeter for biochemical applications", Thermochimica Acta, vol. 445, pp. 144-150, (2006).
Leslie et al., Daniel C.; "Frequency-specific flow control in microfluidic circuits with passive elastomeric features", Nature Physics, vol. 5, Mar. 2009.
Li et al., Wei; "Multiple Modular Microfluidic ($M^3$) reactors for the synthesis of polymer particles", Lab On A Chip, vol. 9, pp. 2715-2721, Jul. 9, 2009.
Lin et al., Francis; "Generation of dynamic temporal and spatial concentration gradients using microfluidic devices", Lab Chip, 2004, 4, 164-167. (Mar. 24, 2004).
Macarron et al, Ricardo; "Impact of high-throughput screening in biomedical research", Nature Reviews Drug Discovery, vol. 10, Mar. 2011.
Malo et al., Nathalie; "Statistical practice in high-throughput screening data analysis", Nature Biotechnology vol. 24, No. 2, Feb. 2006.
Manz et al., A.; "Miniaturized Total Chemical Analysis Systems: a Novel Concept for Chemical Sensing", Sensors and Actuators, B1 (1990), pp. 244-248.
Martinez-Cisneros et al., Cynthia S.; "LTCC microflow analyzers with monolithic integration of thermal control", Sensors and Actuators A, vol. 138, pp. 63-70 Apr. 20, 2007.
Martynova et al., Larisa; "Fabrication of Plastic Microfluid Channels by Imprinting Methods", Analytical Chemistry Division and Semiconductor Electronics Division, vol. 69, No. 23, Dec. 1, 1997.
Mayr et al., Lorenz M.; "Novel trends in high-throughput screening", Current Opinion in Pharmacology, 2009, vol. 9, pp. 580-588.
McCormick et al., Kathryn E.; "Microfluidic Devices for Analysis of Spatial Orientation Behaviors in Semi-Restrained Caenorhabditis elegans", PLoS ONE, vol. 6, Iss. 10, Oct. 2011.
McDonald et al., J. Cooper; "Prototyping of Microfluidic Devices in Poly(Dimethylsiloxane) Using Solid-Object Printing", Analytical Chemistry, vol. 74, No. 7, Apr. 2, 2002.
Miserendino et al., Scott; "Modular microfluidic interconnects using photodefinable silcone microgaskets and MEMS O-rings", Sensors and Actuators, vol. 143, pp. 7-13m (2008).
Mrksich, Milan; Whitesides, George M.; "Patterning self-assembled monolayers using microcontact printing: a new technology for biosensors?", TIBTECH, vol. 13, Jun. 1995.
Nathanson et al., Harvey C; "The Resonant Gate Transistor", IEEE Transaction on Election Devices, vol. ED-14, No. 3, Mar. 1967.
Neils et al., Christopher; "Combinatorial mixing of microfluidic streams", Lab On A Chip, 2004, 4, pp. 342-350. (Apr. 23, 2004).
Noyce, Robert N.; "Microelectronics", Scientific American, Sep. 1977, vol. 237, No. 3.
Oh et al., Kwang; "Design of pressure-driven microfluidic networks using electric circuit analogy", Lab On A Chip, vol. 12, pp. 515-545, 2012.

(56) References Cited

OTHER PUBLICATIONS

Pradere et al., Christophe; "Processing of temperature field in chemical microreactors with infrared thermography", Quantitative InfraRed Thermography Journal, vol. 3, No. 1, pp. 117-135, Apr. 14, 2006.
Reyes et al., Darwin R.; "Micro Total Analysis Systems. 1. Introduction, Theory, and Technology", Analytical Chemistry, vol. 74, No. 12, Jun. 15, 2002.
Rhee et al., Minsoung; "Microfluidic Assembly Blocks", Lab On A Chip, vol. 8, No. 8, pp. 1229-1408, Jul. 4, 2008.
Riche et al., Carson T.; "Fluoropolymer surface coatings to control droplets in microfluidic devices", Lab On A Chip, vol. 14, pp. 1834-1841, 2014.
Riche et al., Carson T.; "Vapor deposition of cross-linked fluoropolymer barrier coatings onto pre-assembled microfluidic devices", Lab On A Chip, vol. 11, pp. 3049-3052, Jul. 27, 2011.
Rogers et al, Chad I.; "3D printed microfluidic devices with integrated valves", Biomicrofluidics, vol. 9, 2015.
Ross, David; "Temperature Measurement in Microfluidic Systems Using a Temperature-Dependent Fluorescent Dye", Analytical Chemistry, vol. 73, No. 17, Sep. 1, 2001.
Samy et al., Razim; "Method for Microfluidic Whole-Chip Temperature Measurement Using Thin-Film Poly(dimethylsiloxane)/Rhodamine B", Analyitcal Chemistry, vol. 80, No. 2, pp. 369-375, Jan. 15, 2008.
Shah et al., Jayna J.; "Generalized Temperature Measurement Equations for Rhodamine B. Dye Solution and Its Application to Microfluidics", Analytical Chemistry, vol. 81, No. 19 Oct. 1, 2009.
Shaikh et al., Kashan A.; "A modular microfluidic architecture for integrated biochemical analysis", Proceedings of the National Academy of Sciences of the United States of America, vol. 102, No. 28, Jul. 12, 2005.
Shoji et al., Shuichi; "Micropump and Sample-injector for Integrated Chemical Analyzing Systems", Sensors and Actuators, A21-A23 (1990), pp. 189-192.
Shoji et al., Shuichi; "Prototype Minature Blood Gas Analyzer Fabricated on a Silicon Wafer", Sensors and Actuators, 14 (1988), pp. 101-107. Oct. 24, 1986.
Smits, Jan G.; "Piezoelectric Micropump with Three Valves Working Peristaltically", Sensors and Actuators, A21-A23 (1990), pp. 203-206.
Stan et al., Claudiu A.; "A microfluidic apparatus for the study of ice nucleation in supercooled water drops", Lab On A Chip, vol. 9, pp. 2293-2305, May 22, 2009.
Steinhart, John S.; Hart, Stanley R.; "Instruments and Methods—Calibration cruves for thermistors", Deap-Sea Research, 1968, vol. 15, pp. 497 to 503. Apr. 15, 1968.
Stiles et al., T.; "Hydrodynamic focusing for vacuum-pumped microfluidics", Microfluid Nanofluid (2005) 1:280-283. (Mar. 31, 2005).
Stone et al., H.A.; "Engineering Flows in Small Devices: Microfluidics Toward a Lab-on-a-Chip", Annu. Rev. Fluid Mech. 2004. 36:381-411.
Su et al, Cheng-Kuan; "Fully 3D-Printed Preconcentrator for Selective Extraction of Trace Elements in Seawater", Analytical Chemistry, vol. 87, pp. 6945-6950, Jun. 23, 2015.
Sun et al., Kang; "Modular microfluidics for gradient generation", Lab On A Chip, vol. 8, pp. 1536-1543, Jul. 23, 2008.
Sundberg, Steven A.; "High-throughput and ultra-high-throughput screening: solution- and cell-based approaches", Current Opinion in Biotechnology, 2000, 11:47-53.
Squires eta al., Todd M.; "Microfluidics: Fluid physics at the nanoliter scale", Reviews of Modern Physics, vol. 77, Jul. 2005.
Terry et al., Stephen C.; "A Gas Chromatographic Air Analyzer Fabricated on a Silicon Wafer", IEEE Transactions on Electron Devices, vol. ED-26, No. 12, Dec. 1979.
PCT Application No. PCT/US2015/035120 International Search Report and Written Opinion dated Sep. 14, 2015.

* cited by examiner

| Name 305 | Visual Indicator 310 | Element Illustration 315 | Circuit Symbol 320 |
|---|---|---|---|
| Connector 325 | | | |
| Straight Pass 330 | | | |
| L-Joint 335 | | | |
| Mixer 340 | | | |
| T-Junction 345 | | | |
| X-Junction 350 | | | |
| Interface 355 | | | |
| XT-Junction 360 | | | |
| XX-Junction 365 | | | |

FIG. 3

DISCRETE ELEMENTS FOR 3D MICROFLUIDICS

CROSS-REFERENCE TO RELATED APPLICATION

This application is based upon and claims priority to U.S. provisional patent application 62/010,107, entitled "Discrete Microfluidic Components for Modular Three-Dimensional Circuits," filed Jun. 10, 2014. The entire content of this application is incorporated herein by reference.

STATEMENT REGARDING FEDERALLY SPONSORED RESEARCH

This invention was made with government support under Grant No. 1R01GM093279 awarded by National Institutes of Health. The government has certain rights in the invention.

BACKGROUND

Technical Field

This disclosure relates to microfluidic circuits and to techniques for constructing them.

Description of Related Art

Microfluidic technology typically includes devices that can manage and move amounts of fluid on a scale of nano-liters or smaller. Typically, microfluidic devices have channels for transferring fluids where the Reynolds number is less than 100 and often times lower than 1. In this regime of Reynolds numbers, the flow may be laminar. Systems of this nature are rapidly becoming desirable tools for a variety of applications, including high-precision materials synthesis, biochemical sample preparation, and biophysical analysis. Microfluidic devices are commonly fabricated in monolithic form by means of microfabrication. This can limit device construction to a planar geometry, which can be functionally limiting and expensive.

Modular microfluidic platforms have been conceived, but are all limited to 2-dimensional platforms, and do not allow for allow for device assembly in 3-dimensions. Furthermore, other modular microfluidic platforms are generally limited in scope (e.g., may only create microfluidic flow paths with little other functionality), are prohibitively expensive, are difficult to use, or use nonstantadized footprints, models, or connectors/ports. Some may only produce very specific types of structures (e.g., mixers). Further still, other modular microfluidic platforms do not allow for *facile* integration of sensors or actuators into their components, which further limits the scope of device applications.

Therefore, an improved modular microfluidic platform is needed.

SUMMARY OF THE CLAIMED INVENTION

A first system for fluid handling is described. The first system includes a first opening on a first module. The first system also includes a microfluidic channel passing through at least part of the first module. The microfluidic channel has at least one endpoint at the first opening. The microfluidic channel allows fluid flow. The first system also includes a first coupling mechanism allowing fluid flow between the first opening and a second module.

A second system for fluid handling is described. The second system includes a plurality of modules. Each module of the plurality of modules includes at least one opening that serves as an endpoint of a microfluidic channel allowing for fluid flow and passing through at least part of the module. The plurality of modules may be arranged into an arrangement of modules that fits within a regular polyhedral grid. Fluid may flow through at least a subset of the plurality of modules via the microfluidic channel of each module of the subset of the plurality of modules.

A method for fluid handling is described. The method includes receiving a fluid at a first opening of a first module, the first opening coupled to a second module, the second module including a second microfluidic channel. The method also includes passing the fluid through a microfluidic channel that passes through the first module from the first opening to a second opening. The method also includes transmitting the fluid through the second opening, the second opening coupled to a third module, the third module including a third microfluidic channel.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional modules or steps and/or without all of the modules or steps that are illustrated. When the same numeral appears in different drawings, it refers to the same or like modules or steps.

FIG. 3 illustrates an example library of different microfluidic elements, including the connector and different types of modules.

DETAILED DESCRIPTION OF ILLUSTRATIVE EMBODIMENTS

Figure 1A:
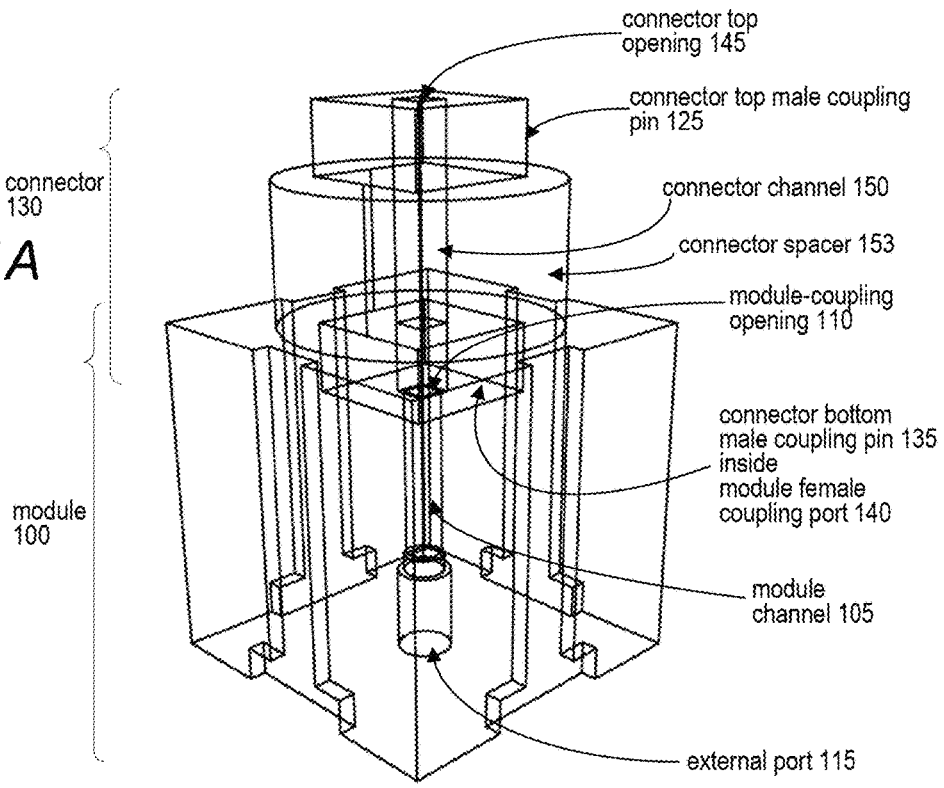
FIG. 1A illustrates a perspective view of a single exemplary module with a single exemplary connector coupled to the module.

Illustrative embodiments are now described. Other embodiments may be used in addition or instead. Details that may be apparent or unnecessary may be omitted to save space or for a more effective presentation. Some embodiments may be practiced with additional modules or steps and/or without all of the modules or steps that are described.

A microfluidic platform is described herein that includes modular, reconfigurable modules that contain fluidic and sensor elements that may be configured into many different microfluidic circuits. This may allow for application of network analysis techniques, like those used in classical electronic circuit design, which may facilitate a straightforward design of predictable flow systems.

A module may be provided with at least one opening, the opening being an endpoint of a microfluidic channel that passes through at least part of the module. A set of multiple such modules may be arranged into an arrangement of modules, which may be coupled together using one or more coupling mechanisms included on each module. The arrangement of modules may fit within a regular polyhedral grid, and each module within the arrangement of modules may have a form suitable for arrangement of the modules within the regular polyhedral grid. Fluid may then flow through at least a subset of the arrangement of modules via the microfluidic channel of each module of the subset of the arrangement of modules. Some modules may include sensors, actuators, or inner microfluidic channel surface coatings. The arrangement of modules may form a microfluidic circuit that can perform a microfluidic circuit function.

A sample library of standardized modules and connectors can be manufactured following this approach. Flow characteristics of the modules can be derived to facilitate the design and construction of a tunable concentration gradient generator device with a scalable number of parallel outputs. Systems can also be rapidly reconfigurable by constructing variations of a microfluidic circuit for generating monodisperse microdroplets in two distinct size regimes and in a high throughput mode by simple replacement of emulsifier sub-circuits. Active process monitoring can be introduced in the system by constructing an optical sensing element for detecting water droplets in a fluorocarbon stream.

By moving away from large-scale integration towards standardized discrete elements, complex 3-D microfluidic circuits can be designed and assembled using approaches comparable to those used by the electronics industry.

The standardized footprint of modules allows for three dimensional lattice assemblies. A lattice can be defined as a regular periodic set of points in space associated with the tiling of a primitive cell. Here a primitive cell is constructed such that by definition it does not contain a lattice point other than at its corners. A module like that of which has been described may occupy an integer number of primitive cells in the lattice. The shape of a module may be determined by one of more primitive cells. For example, in a cubic lattice, the modules may be arranged to be simply cubic or an integer number of primitive cubes in length, width and height. More broadly, a lattice with a polyhedral primitive cell may have an integer number of primitive polyhedrals.

FIG. 1A illustrates a perspective view of a single exemplary module with a single exemplary connector coupled to the module.

The exemplary module 100 of FIG. 1A is substantially cube-shaped. In other cases, a module similar to the module 100 of FIG. 1A may be cylindrical, spherical, or polyhedral (e.g., a cube, a rectangular prism, a polygonal prism, a polygonal pyramid, a tetrahedron, an octahedron, a dodecahedron, an icosahedron, or any other three-dimensional shape that may be produced from an arrangement of polygons). While the size of each side of the module 100 of FIG. 1A is substantially identical (e.g., a cube), a different module may be longer in one or more directions (e.g., a rectangular prism or an "L" or "T" or "X" or "plus symbol" shape).

The length of each side of the module 100 may be at a picometer scale (e.g., between 1 and 1000 picometers), at a nanometer scale (e.g., between 1 and 1000 nanometers), at a micrometer scale (e.g., between 1 and 1000 micrometers), at a millimeter scale (e.g., between 1 and 1000 millimeters), at a centimeter scale (e.g., between 1 and 10 centimeters). In some exemplary modules, at least one side of the module 100 may be approximately 0.1 to 10 centimeters in length. In one embodiment, at least one side of the module 100 may be approximately 1 centimeter in length.

The module 100 includes a module-coupling opening 110, which may be any shape. The module-coupling opening 110 of FIG. 1A is circular in shape, but it may be ovoid or polygonal (e.g., the module-coupling opening 110 may be a square, a triangle, a rectangle, a pentagon, a hexagon, an octagon, or any other polygonal shape).

The module-coupling opening 110 of the module 110 is located at a female coupling port 140 of the module 100. The female coupling port 140 is an inlet designed to accept a male coupling pin, and may include an elastic reversible seal (or other type of seal, o-ring, or gasket) to secure a fit between the female coupling port 140 and male coupling pin. For example, the seal may use silicone, rubber, or plastic. The female coupling port 140 may also include an adhesive (e.g., glue) to keep a male coupling pin in place once inserted. The female coupling port 140 of FIG. 1A is illustrated in a coupled state, where the female coupling port 140 of FIG. 1A is coupled with the bottom male coupling pin 135 of the connector 130.

The female coupling port 140 of FIG. 1A is in the shape of a rectangular prismic indentation into the center of the top face of the module 100, but may be another shape (e.g., a cylindrical indentation, a ovoid cylindrical indentation, a polygonal prismic indentation). Similarly, the bottom male coupling pin 135 and top male coupling pin 125 of the connector 130 of FIG. 1A in the shape of a rectangular prismic extrusion from the circular bottom and top faces of the connector 130 but may be another shape (e.g., a cylindrical extrusion, a ovoid cylindrical extrusion, a polygonal prismic extrusion).

The module 100 also includes an external port 115. The external port 115 may be a port that allows fluid flow to and from an external device (not shown) that may attach to the module 100 using the external port 155. The external port 115 may be of a size that allows a standardized fluid transfer interface with existing external devices. For example, the external port 115 may be designed to snugly fit widely available polyether ether ketone (PEEK) tubing (e.g., typically 1/16 inch outside diameter, 1/8 inch outside diameter, 1.8 millimeter outside diameter) or capillary PEEK tubing (e.g., typically 360 micrometer outside diameter, 510 micrometer outside diameter, or 1/32 inch outside diameter) in order to allow users to interface with their existing external devices without having to commit to a proprietary chip-to-world interconnect solution. The channel 105 and/or module-coupling opening 110 may thus have a similarly sized outside diameter as any of the sizes of PEEK or capillary PEEK tubing described above. Alternately, the external port 115 may include a proprietary fluid transfer port or connector.

The external port 115 may in some cases include a seal to better maintain a connection with an external device. Such a seal may be an elastic reversible seal (or other type of seal, o-ring, or gasket) to secure a fit between the external port 115 and external device (e.g., which may connect to the external port 115 through PEEK tubing). For example, the seal may use silicone, rubber, or plastic. The external port 115 may also include an adhesive (e.g., glue) to keep an external device or tubing in place once such a connection is made.

The external device may include, for example, pump, a reservoir, or a sensor.

The module 100 of FIG. 1A includes a module channel 105 with one endpoint at the module-coupling opening 110 and the other endpoint at the external port 115. The module channel 105 is a microfluidic channel that may transfer a fluid to and/or from the module-coupling opening 110, and to and/or from the external port 115. The channel 105 may be a cylindrical channel as illustrated in FIG. 1A, or may alternately be any other three-dimensional shape that may be used for fluid transfer (e.g., an ovoid cylindrical channel or a polygonal prism-shaped channel).

The module 100 of FIG. 1A is shown coupled to a connector 130. The connector 130 is an element with two male coupling pins that is designed to assist in coupling a first module to a second module (e.g., see the three coupled modules of FIG. 1B). In particular, the connector 130 includes a top male coupling pin 125 that is uncoupled and a bottom male coupling pin 135 that is illustrated as coupled to the female coupling port 140 of the module 100. A seal may in some cases be included as part of each male coupling pin to better maintain a connection between the male coupling pin and a female coupling port. For example, such a seal may be an elastic reversible seal (or other type of seal, o-ring, or gasket) to secure a fit between the male coupling pin 135 and female coupling port 140. For example, the seal may use silicone, rubber, or plastic. The male coupling pin 135 may also include an adhesive (e.g., glue) to keep a male coupling pin 135 in place once inserted into the female coupling port 140.

The connector 130 includes a connector channel 150 that is illustrated as a square-prism-shaped tube in FIG. 1A (but may alternately be a different shape, such as a cylindrical tube or polygonal prismic tube). The connector channel 150 allows fluid flow between the connector top opening 145 at the end of the top male coupling pin 125 and the module-coupling opening 110 at the surface of the female coupling port 140 of the module 100 (coupled to the end of the bottom male coupling pin 135). The square prism shape of the male coupling pins and connector channel 150 may be used for optical clarity (e.g., quick differentiation of interfaces) and to ensure consistent cross-sectional channel orientation between the channel 105 and connector channel 150.

While the connector channel 150 is illustrated using a different shape (e.g., a square prism shaped tube) as the shape of the channel 105 (e.g., a cylindrical tube), it should be understood that this shape different is exemplary rather than limiting. The connector channel 150 and channel 105 may be the same shape in some cases.

The connector 130 of FIG. 1A also includes a spacer 153, which is cylindrical as illustrated in FIG. 1A (but may alternately be a different shape, such as a polygonal prism or a sphere). The spacer 153 is optional (e.g., the connector 130 may simply be two male coupling modules 125 and 135 back-to-back). If the spacer 153 is included as part of the connector 130, it may be transparent or translucent and behave as a lens that optically magnifies the appearance of fluid flowing through the connector channel 150 to aid in post-assembly test and inspection. The spacer 153 may also assist in more easily putting together multiple modules (e.g., by making the connector 130 larger and easier to grasp) and more easily viewing separate modules once multiple modules are coupled together (e.g., by spacing the modules farther apart and allowing viewing of the fluid flow via the lens functionality of the spacer 153).

A second module (not shown) may couple to the connector 130 at the connector top male coupling pin 125 (e.g., at a female coupling port of the second module). The module 100 may thus be coupled to a second module (not shown).

The first module 100 may alternately be coupled to a second module (not shown) without the connector 130 if the second module (not shown) includes a male coupling pin oriented similarly to the bottom male coupling pin 135 of FIG. 1A.

Figure 1B:
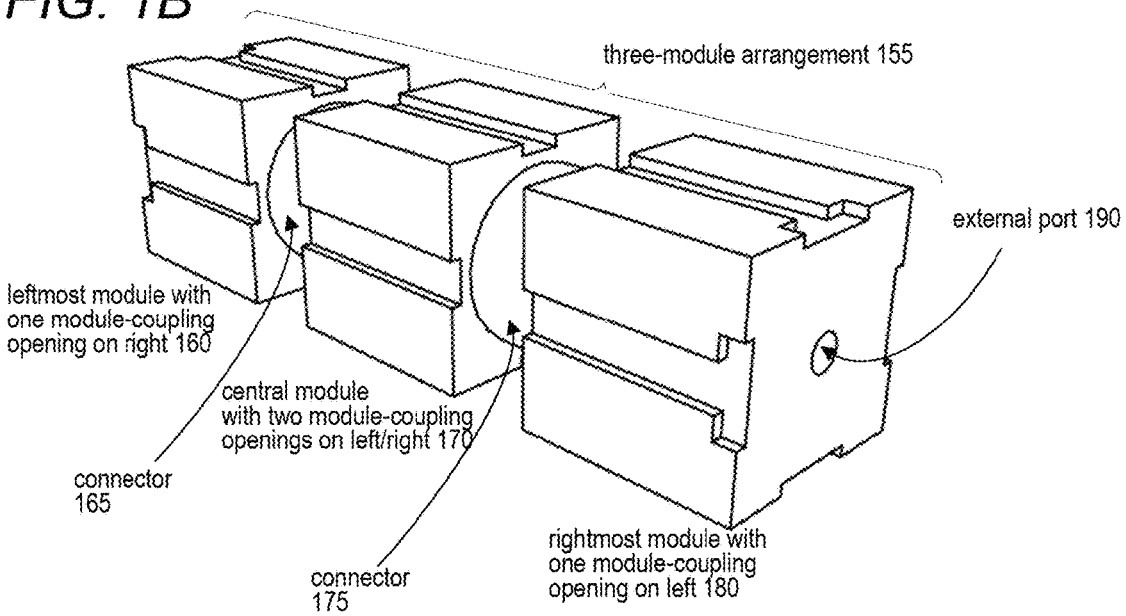
FIG. 1B illustrates a perspective view of three exemplary modules coupled together in a three-module arrangement in the shape of a line.

Another module may include, in place of the external port 115 of the module 100, a second module-coupling opening with a second female coupling port similar to the module-coupling opening 110 and female coupling port 140 (e.g., see central module 170 of FIG. 1B). This may allow such a module to be coupled to two different modules on either end. Yet other modules may include one or more additional module-connecting openings and corresponding female coupling ports (e.g., see the various types of modules. Yet other modules may include additional external ports similar to external port 115. Some modules may include multiple module-connecting openings and corresponding female coupling ports on a single face. Some modules may include multiple external ports on a single face.

Some modules may include various mechanisms, such as sensors (thermal sensor, a chemical sensor, an optical sensor, an electrical sensor, a mechanical sensor, a magnetic sensor), mixer modules (e.g., which may include helical or winding channels in order to aid the mixing of two fluids), resistors (e.g., that slow the flow of a fluid the higher the resistance of the resistor, for example using channels that are lengthened using turning or winding or helical paths, channels that are narrowed, or channels that are partially occluded such as through a porous solid placed within the channel), actuators (e.g., powering valves, magnets pumps, or reservoirs). Various types of exemplary modules are listed in FIG. 3.

Methods of fabrication of the module 100 may utilize Polydimethylsiloxane (PDMS) or Poly(methyl methacrylate) (PMMA) by lost wax casting. Other materials that may be used through additive manufacturing techniques may include but are not limited to acrylates, acrylonitrile butadiene styrene (ABS) plastic, polylactic acid (PLA), polycarbonates, polypropylenes, polystyrenes, other polymers, steel, stainless steel, titanium, gold, and silver.

One or more exterior faces of each module 100 may be marked or embedded with symbolic visual indicators 120 that point out the orientation and/or type of element. This may aid in rapid assembly based on diagrammatic expression of the intended system. These may be similar to orientation marks on the packaging of fundamental discrete electronic components, such as resistors, capacitors, inductors, and diodes. For example, the visual indicators 120 of FIG. 1A indicate that the module 100 includes a module-coupling opening 110 and a external port 115. The visual indicator 120 of FIG. 1A is a shape similar to a "T" that is engraved into each side surface of the module 100, with the long central pillar of the "T" shape aligned with the channel 105 and endig at the module-coupling opening 110, and the perpendicular endpiece of the "T" shape corresponding to the face of the module 100 that includes the external port 115. The visual indicator 120 may be one or more exterior surfaces of a module 100 (e.g., in FIG. 1A, the four exterior surfaces not including the module-coupling opening 110 and the closed endpoint 115). A visual indicator 120 may include an engraved shape (e.g., as in FIG. 1A), an embossed shape, an engraved alphanumeric string, an embossed alphanumeric string, a printed image, a printed alphanumeric string, a printed barcode, an engraved barcode, an embossed barcode, or some combination thereof. Various types of exemplary modules and exemplary corresponding visual identifiers are listed in FIG. 3.

The top male coupling pin 125 of the connector 130 may then be used to couple or affix a second module (not shown) to the first module. In particular, a female coupling port (not shown) of the second module (not shown) may couple with the top male coupling pin 125 of the connector 130. The bottom male coupling pin 135 of the connector 130 may then couple with the female coupling port 140 of the first module 100 as illustrated in FIG. 1A, thus coupling the first module 100 with the second module (not shown).

In an alternate embodiment, the connector 130 may be permanently coupled to the module 100 (e.g., the bottom male coupling pin 135 of the connector 130 and the female coupling port 140 of the module 100 are fused together, adhesively attached, or manufactured without any separation).

In another alternate embodiment, the module 100 may include a male coupling pin in place of the female coupling port 140, while the connector 130 may include two female coupling ports in place of the top male coupling pin 125 and bottom male coupling pin 135.

Module and Connector Design

FIG. 1B illustrates a perspective view of three exemplary modules coupled together in a three-module arrangement in the shape of a line.

The three-module arrangement 155 of FIG. 1B includes, from left to right, a leftmost module with one opening 160, a connector 165, a central module with two openings, a connector 175, and a rightmost module with one opening 180.

The connector 165 and connector 175 may be separate male-to-male connectors as illustrated in FIG. 1A. If this is the case, the leftmost module 160 then includes a single female coupling port on its rightmost face, the rightmost module 180 includes a single female coupling port on its leftmost face, and the central module 170 includes a first female coupling port on its leftmost face and a second female coupling port on its rightmost face. The connector 165 connects the leftmost module 160 to the central module 170, and the connector 175 connects the central module 170 to the rightmost module 180.

Keeping the module-based coupling mechanisms female and the spacer-based coupling mechanisms male allows for consistency in joinder operations between different modules. In an alternate embodiment, the module 160, module 170, and module 180 may include male coupling pins, while the connector 165 and connector 175 may each include two female coupling ports. Consistency in joinder operations between different modules is maintained using this coupling method. In yet another alternate embodiment, the modules of FIG. 1B may have a mixture of male and female coupling ports, and the spacers of FIG. 1B may then also have a mixture of male and female coupling ports. Such an alternate embodiment may break consistency of joinder operations, but may be useful, for example, to suggest to a user that certain modules should be combined in a particular order. Such a suggestion may also be accomplished by differently-shaped male coupling pins and corresponding female coupling ports for modules that should be coupled together.

While the connector 165 and connector 175 may be separate elements from the modules of FIG. 1B, this need not be the case. In particular, each of the connector 165 and the connector 175 may be permanently coupled directly to at least one of the modules of FIG. 1B as discussed as an alternate embodiment of FIG. 1A. For example, connector 175 may be coupled to the rightmost module 180 and connector 165 may be coupled to the central module 170. Alternatively, connector 175 may be coupled to the central module 170 and connector 165 may be coupled to the leftmost module 160. Alternatively, connector 175 may be coupled to the rightmost module 180 and connector 165 may be coupled to the leftmost module 160. Alternatively, connector 175 and connector 165 may both be coupled to the central module 170 (e.g., so that the central module 170 has two male coupling pins 125).

Figure 2A:
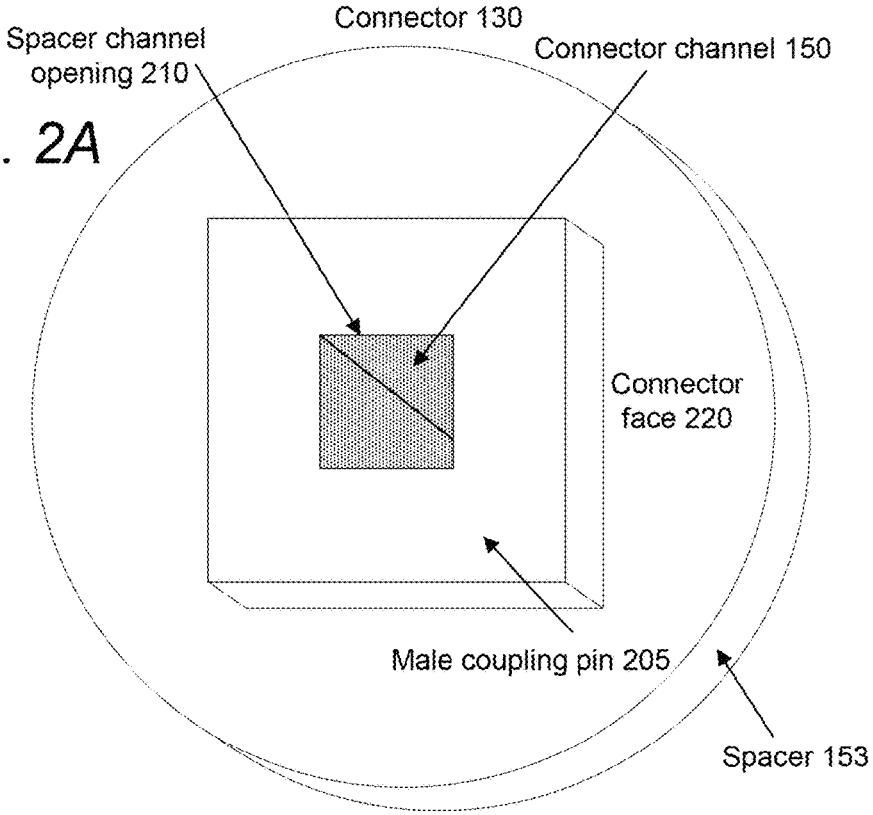
FIG. 2A illustrates a front view of a male coupling pin of a connector.

FIG. 2A illustrates a front view of a male coupling pin of a connector.

The connector 130 of FIG. 2 includes a spacer 153 with a connector face 220 (e.g., also a face of the spacer 153) and includes a male coupling pin 205 (e.g., the top male coupling pin 125 or bottom male coupling pin 135) with square connector top opening 210 (e.g., connector top opening 145) to a square-prism-shaped connector channel 150.

The channel opening 210 (and therefore channel 150) may be centered at the top male coupling pin 205. The seating of the top male coupling pin 205 within a female coupling port (not shown), which may be an inlet or port shaped like an inward rectangular prism, may ensure self-alignment and continuity between channels, as illustrated in FIG. 1A between the connector channel 150 and the module channel 105. Unlike jumper-cable style interconnects, coupling mechanisms of this style may suffer from an accumulation of particles or increase requirements for sample volumes by breaking circuit routing out of the microfluidic environment.

The connector channel 150 may have, for example, an approximately 1 millimeter (mm) side length (or, e.g., a 1 mm diameter if the connector channel 150 was a circular prism and the connector top opening 210 a circle). Alternately, a different side length or diameter may be used that maintains a low Reynolds number.

The connector channel 150 may be larger than a module channel 105 (e.g., module channel 105 of module 100 of FIG. 1A). For example, a module channel 105 may have a 500-750 micrometer side length (or diameter). This may limit the contribution of the connector channel 150 to hydrodynamic resistance, while ensuring low Reynolds number flow and microliter scale enclosed volumes, preserving the hallmark conditions for microfluidic flow. Tables 2 and 3 herein set forth examples.

Figure 2B:
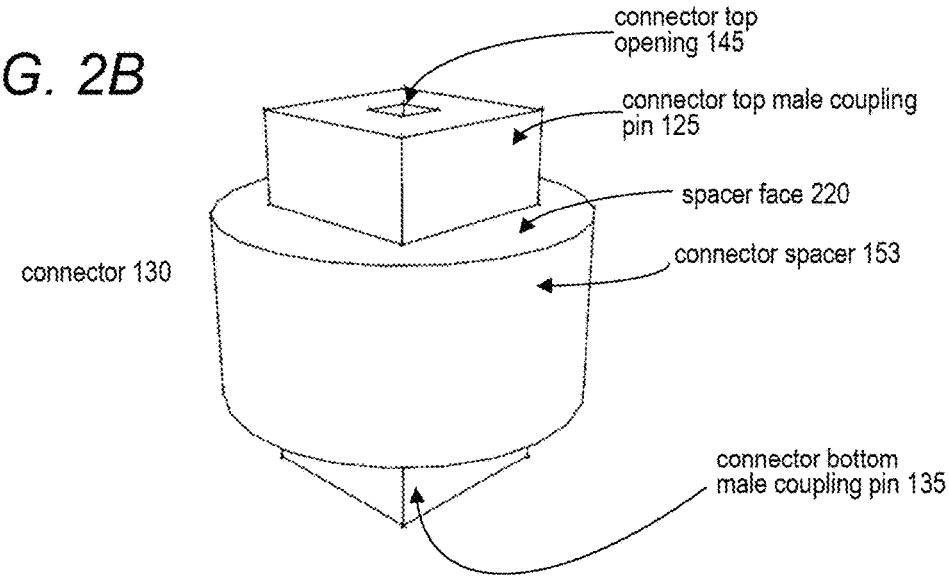
FIG. 2B illustrates a perspective view of a connector.

FIG. 2B illustrates a perspective view of a connector. In particular, FIG. 2B illustrates a perspective view of the connector 130 of FIG. 1 with opaque sides (e.g., the connector channel 150 is not visible) while it is separate from the module 100.

FIG. 3 illustrates an example library of different microfluidic elements, including the connector and different types of modules. The connector 325 (e.g., the connector 130 of FIG. 1A, FIG. 2A, and FIG. 2B) may be used to couple the various different types of modules together. The modules include a straight pass 330, an L-joint 335, a mixer 340, a T-junction 345, an interface 355 (e.g., the module 100 of FIG. 1A is an interface module 355), an XT-Junction 360, an XX-Junction 365).

Each module may have a corresponding visual indicator 310 that may be used to identify it, similarly to the "T" shaped visual indicator 120 of module 100. Each module may also have a corresponding circuit symbol 320. The circuit symbol 320 corresponding to each module associates the particular module with a circuit symbol commonly used in electronics (e.g., resistors, power sources, ground). The various modules may perform functions that allow arrangements of modules to behave similarly to electronic circuits, with the circuit symbols 320 identified in FIG. 3 being possible circuit symbols that may be used corresponding to each identified element.

The library of FIG. 3 is arranged in a table. The first (leftmost) column 305 names particular microfluidic elements 305. The second column 310 identifies an exemplary visual indicator 310 that may be used to identify each named element. The third column 315 illustrates an exemplary illustrated embodiment 315 of the identified element. The fourth column 320 identifies a circuit symbol 320 that may correspond to the particular module identified.

Each of the modules depicted in FIG. 3 may have different terminal hydrodynamic properties. Example terminal hydrodynamic properties of these example modules are given in the following Table 1:

TABLE 1

| Element | h (μm) | Label | R (MPa · s · m$^{-3}$) | $R_{exp}$ (MPa · s · m$^{-3}$) |
|---|---|---|---|---|
| Connector | 1000 | $R_{C,1000}$ | 227.2 | 223.1 ± 5.5% |
| | 500 | $R_{SP,500}$ | 2726.4 | 2720.41 ± 3.7% |
| Straight Pass | 750 | $R_{SP,750}$ | 538.55 | 525.69 ± 6.2% |
| | 1000 | $R_{SP,1000}$ | 170.4 | 169.67 ± 3.1% |
| | 500 | $R_{L,500}$ | 2726.4 | 2720.41 ± 3.7% |
| L-Joint | 750 | $R_{L,750}$ | 538.55 | 525.69 ± 6.2% |
| | 1000 | $R_{L,1000}$ | 170.4 | 169.67 ± 3.1% |
| | 635 | $R_{M,635}$ | 16227 | 17708.04 ± 4.2% |
| Mixer | 750 | $R_{L,750}$ | 6395.3 | 6218.5 ± 7.2% |
| | 1000 | $R_{L,1000}$ | 1846 | 1838.1 ± 3.1% |
| | 500 | $R_{(T),500}$ | 1363.2 | 1360.21 ± 3.7% |
| T-Junction | 750 | $R_{(T),750}$ | 269.28 | 262.85 ± 6.2% |
| | 1000 | $R_{(T),1000}$ | 85.2 | 84.835 ± 3.1% |
| | 500 | $R_{(X),500}$ | 1363.2 | 1360.21 ± 3.7% |
| X-Junction | 750 | $R_{(X),750}$ | 269.28 | 262.85 ± 6.2% |
| | 1000 | $R_{(X),1000}$ | 85.2 | 84.835 ± 3.1% |
| Interface | 750 | $R_{I,750}$ | 448.79 | 438.08 ± 6.2% |
| XT-Junction | 750 | $R_{(XT),750}$ | 269.28 | 262.85 ± 6.2% |
| XX-Junction | 750 | $R_{(XX),750}$ | 269.28 | 262.85 ± 6.2% |
| IR Sensor | 642.5 | $R_{IR,642.5}$ | 999.95 | 993.57 ± 0.99% |

Table 1 charts each element listed in FIG. 3 as well as an Infrared ("IR") sensor. Table 1 includes a measurement "h", which measures a side length of a channel (e.g., assuming a square-prism-shaped channel) of the microfluidic element (e.g., the module channel or the connector channel if the element is the connector) in micrometers ("μm"). Table 1 gives each of these modules (at each channel side length) a label. Table 1 then gives a calculated hydrodynamic resistance R of the element, in units of Megapascal (MPa) seconds (s) per cubic meter (m^−3), as well as an experimentally observed hydrodynamic resistance $R_{exp}$ in the same units.

The hydraulic resistance of each element was calculated for use in circuit analysis assuming low Reynolds number flow, and varied by either modulating the cross-sectional side length of the channel or the length of the channel segment packed into the module. Each element was designed using straight channel segments with square cross-sections such that the net resistance for geometrically complex two-port devices (e.g. helically shaped mixers) could be computed from the series addition of internal resistances. The resistances of segments themselves were calculated using the following equation:

$$R_{hyd} = \frac{28.4\eta L}{h^4}$$

This equation was derived from the solution to the Navier-Stokes equation for Poiseuille Flow in straight channels. See Bruus, H. *Theoretical Microfluidics*. η is the dynamic viscosity of pure water at room temperature (1 mPa s), L is the length of a channel segment, and h is the height or width of the (square cross-section) channel.

In order to determine the approximate resistance of the modules to use in a further network analysis of assembled circuits, the average cross-sectional side-length of several channels was optically measured, as reflected in the following Table 2, and the variation from designed values was determined:

TABLE 2

| h (μm) | $h_{measured}$ (μm) | n |
|---|---|---|
| 1000 | 1001 ± 8 | 75 |
| 750 | 754 ± 12 | 100 |
| 642.5 | 644 ± 2 | 12 |
| 635 | 621 ± 7 | 12 |
| 500 | 500 ± 5 | 36 |

In Table 1, the values "h" illustrate the side lengths of modules as intended, in micrometers. The values "$h_{measured}$" illustrate an average of side lengths of actually produced microfluidic elements. The values "n" are a sample size of the number of experimental microfluidic elements produced at the given side lengths.

The expected resistance and tolerance (Table 1) for each element associated with these values was found to deviate within a range comparable to that of standard discrete electronic resistors. For elements with more than two ports, an equivalent internal circuit model was constructed and the internal segment resistance is stated explicitly. In elements with bends and corners, the resistance for each straight internal segment was added in series by assuming low-Reynolds number (i.e. purely laminar) flow.

Tunable Mixing Through Flowrate Division

The accuracy of the element resistance calculations was gauged by constructing a parallel circuit that compares disparate branch flow rates due to a constant pressure source.

Figure 4A:
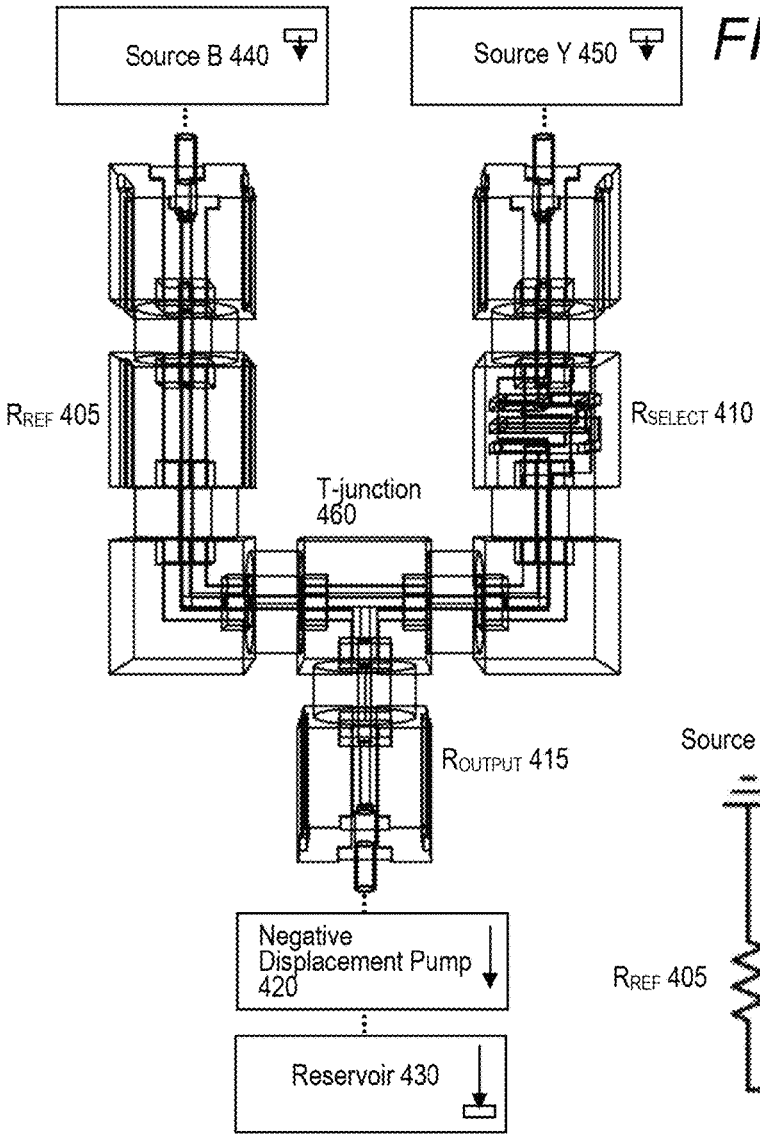
FIG. 4A illustrates an exemplary 2-input, 1-output concentration gradient generator device in which a single branch resistor varies the mixing ratio.

FIG. 4A illustrates an exemplary 2-input, 1-output concentration gradient generator device in which a single branch resistor varies the mixing ratio. The single branch resistor is located on the right branch of the device and is labeled as $R_{SELECT}$ 410 in FIG. 4A, and is a mixer module 340. The left branch of the device instead includes a straight pass module 330 in the corresponding location, labeled $R_{REF}$ 405 (e.g., a "reference" resistance). The left branch is coupled via an external port 115 to a source B 440, while the right branch is coupled via an external port 115 to a source Y 450. The two branches meet at a T-junction 460 when the fluid is pulled using a negative displacement pump 420 from the source B 440 and source 450 and eventually into the reservoir 430. An output resistance is measured after the T-junction 460 as $R_{OUTPUT}$ 415.

The negative displacement pump 420 may, for example, be a syringe pump.

Figure 4B:
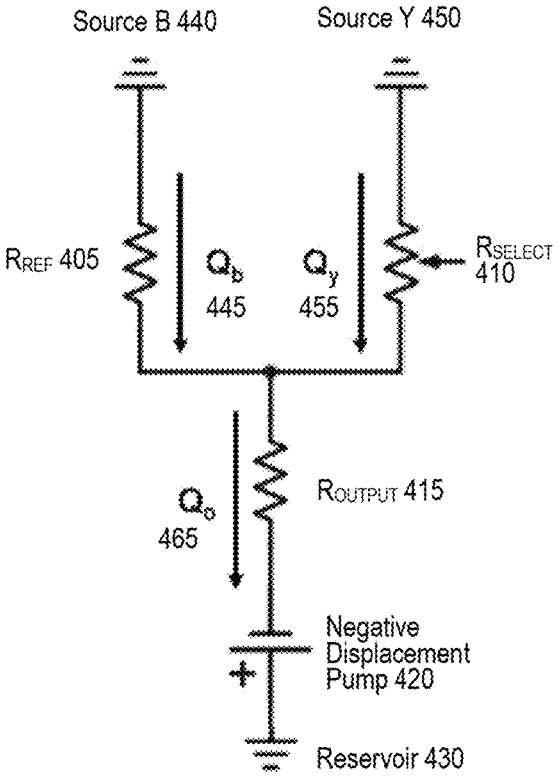
FIG. 4B illustrates the exemplary 2-input, 1-output concentration gradient generator device of FIG. 4A in symbolic circuit notation.

FIG. 4B illustrates the exemplary 2-input, 1-output concentration gradient generator device of FIG. 4A in symbolic circuit notation. In particular, $R_{REF}$ 405, $R_{SELECT}$ 410, $R_{OUTPUT}$ 415 are depicted as resistors. Source B 440 (e.g., a reservoir filled with a first source fluid), Source Y 450 (e.g., a reservoir filled with a second source fluid), and Reservoir 430 (e.g., a reservoir to receive the resulting mixed output fluid) are depicted as ground elements. The negative displacement pump 420 is depicted as a power source. Fluid flow from Source B 440 in the left branch is depicted as $Q_B$ 445. Fluid flow from Source Y 450 in the right branch is depicted as $Q_Y$ 455. Fluid flow after the T-junction 460 (e.g., in the output prong) is depicted as $Q_O$ 465.

The assembly illustrated in FIG. 4A and FIG. 4B was modeled as an equivalent circuit consisting of two branch resistors $R_R$ and $R_s$ grounded by two source reservoirs (e.g., Source B 440 and Source Y 450) and terminated by outlet resistor Ro and an outlet reservoir 430. The Source B 440 and Source Y 450 may, for example, be reservoirs of two different dyes, such as blue and yellow. Each branch was designed to differ only in resistance, specifically at the reference and selected module resistance ($R_{ref}$ 405 and $R_{select}$ 410), while having identical support modules resulting in equal structural resistance $R_{struct}$. All resistors in the equivalent circuit model were approximated by series addition of their contributing element resistances in the actual module assembly (see FIG. 3 and the "Label" column of Table 1 for subscript nomenclature):

$$R=R_{I,750}+R_{(T),750}+3R_{C,1000}+R_{L,750}+R_{SP,750}=R_{struct}+R_{ref}$$

$$R_s=R_{I,750}+R_{(T),750}+3R_{C,1000}+R_{L,750}+R_{SP,750}=R_{struct}+R_{select}$$

$$R_o=R_{(T),750}+R_{C,1000}+R_{I,750}$$

The module reference resistor $R_{ref}$ 405 and variable resistor $R_{select}$ 410 may uniquely control how much of the source fluids (e.g., blue and yellow dye or non-oil liquid) enter the outlet T junction by throttling the action of the pressure source differently in their respective branches. This may be analogous to the use of a current divider in electronic circuit design to deduce an unknown resistance with respect to a known resistance. Nodal analysis was applied in the T-junction in order to calculate the pressure where the two dye streams were combined, such that $Q_o=Q_y+Q_b$. The contribution of each dye stream to the outlet streams was then computed by simple application of Poiseuille's Law (deltaP=QR) (delta of Pressure=flow rate*hydrodynamic resistance), to each branch resistor:

$$Q_y = -P\left(\frac{R}{RR_s + R_oR_s + R_oR}\right)$$

$$Q_b = -P\left(\frac{R_s}{RR_s + R_oR_s + R_oR}\right)$$

The volumetric mixing ratio $m_o$ of dye streams combined in the outlet resistor was predicted to have simple dependency on only the selected, reference, and branch structural resistances:

$$m_o = \frac{Q_y}{Q_b} = \frac{R_{struct} + R_{ref}}{R_{struct} + R_{select}}$$

Figure 5:
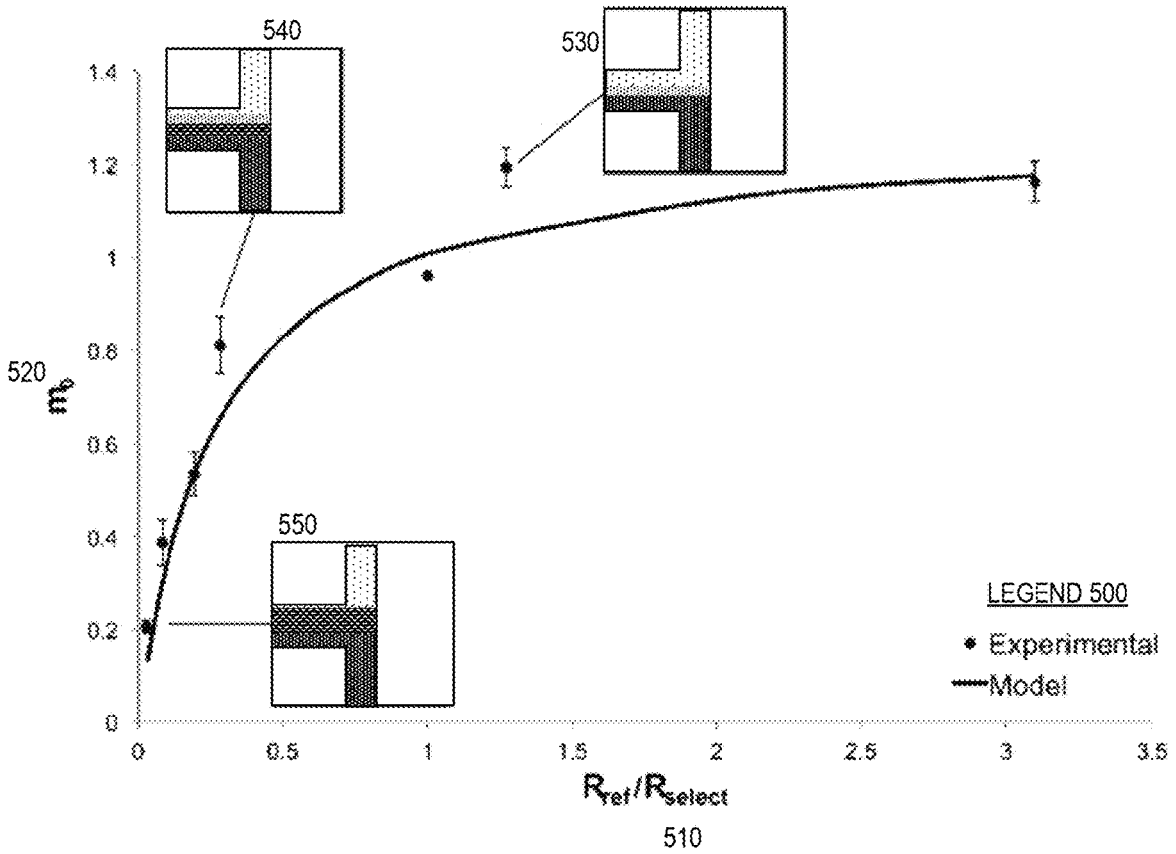
FIG. 5 is a graph comparing a mixing ratio to a ratio of resistances at the two branches of the gradient generator device of FIG. 4A and FIG. 4B that includes model data as well as experimental data, and illustrates a dark-colored fluid mixing with a light-colored fluid at various experimental points on the graph.

FIG. 5 is a graph comparing a mixing ratio to a ratio of resistances at the two branches of the gradient generator device of FIG. 4A and FIG. 4B that includes model data as well as experimental data, and illustrates a dark-colored fluid mixing with a light-colored fluid at various experimental points on the graph. The mixing ratio ($m_0$ 520) is illustrated along the vertical axis of the graph, while the ratio of resistances at the two branches of the gradient generator device ($R_{ref}/R_{select}$ 510=$R_{ref}$ 405 divided by $R_{select}$ 410) is illustrated along the horizontal axis. As explained in the legend 500, the line of FIG. 5 depicts modeled data according to the equations above, while the points depict experimental results.

The various square inserts (530, 540, 550) in the figure illustrate depictions of the co-flowing streams at the T-junction 460 such that the ratio of stream widths was used to find the output mixing ratio $m_o$. The depiction is based on experimental results using a blue dye and a yellow dye, but herein is recolored as a dark-colored fluid and a light-colored fluid. The method of Park et al. (Choi S, Lee M G, Park J-K, Biomicrofluidics, 2010) was adapted to measure several mixing ratios with varying $R_{select}$ 410 and compared to theoretical values calculated from the equation above, validating the simple nodal model with good agreement between the experimental results and the model. The resident widths of unmixed collinear dye streams were measured optically in the junction before diffusive mixing could occur. Assuming that the two dyed water streams have equal dynamic viscosity, the ratio of their resident widths may then be directly proportional to their flow rates and thus the resistances of their originating branches.

In particular, the graph of FIG. 5 illustrates results in which Source Y 450, which is at the same branch as $R_{select}$ 410, was filled with yellow dye (here illustrated as light-colored fluid) and Source B 440, which is at the same branch as $R_{ref}$ 405, was filled with blue dye (here illustrated as dark-colored fluid). Higher values for $R_{select}$ 410 are illustrated as further left along the horizontal axis 510. Higher values for $R_{select}$ 410 thus resulted in less yellow dye and more blue dye at the output (facing left). For example, the result 550 has the least yellow dye due to a higher $R_{select}$ 410 resistance value, the result 530 has the most yellow dye due to a lower $R_{select}$ 410 resistance value, and the result 540 has the is in between.

With the ability to quickly modify the assembly, this circuit becomes a useful tool for generating precise mixing ratios based on a comparison of select and reference module resistances.

Figure 6A:
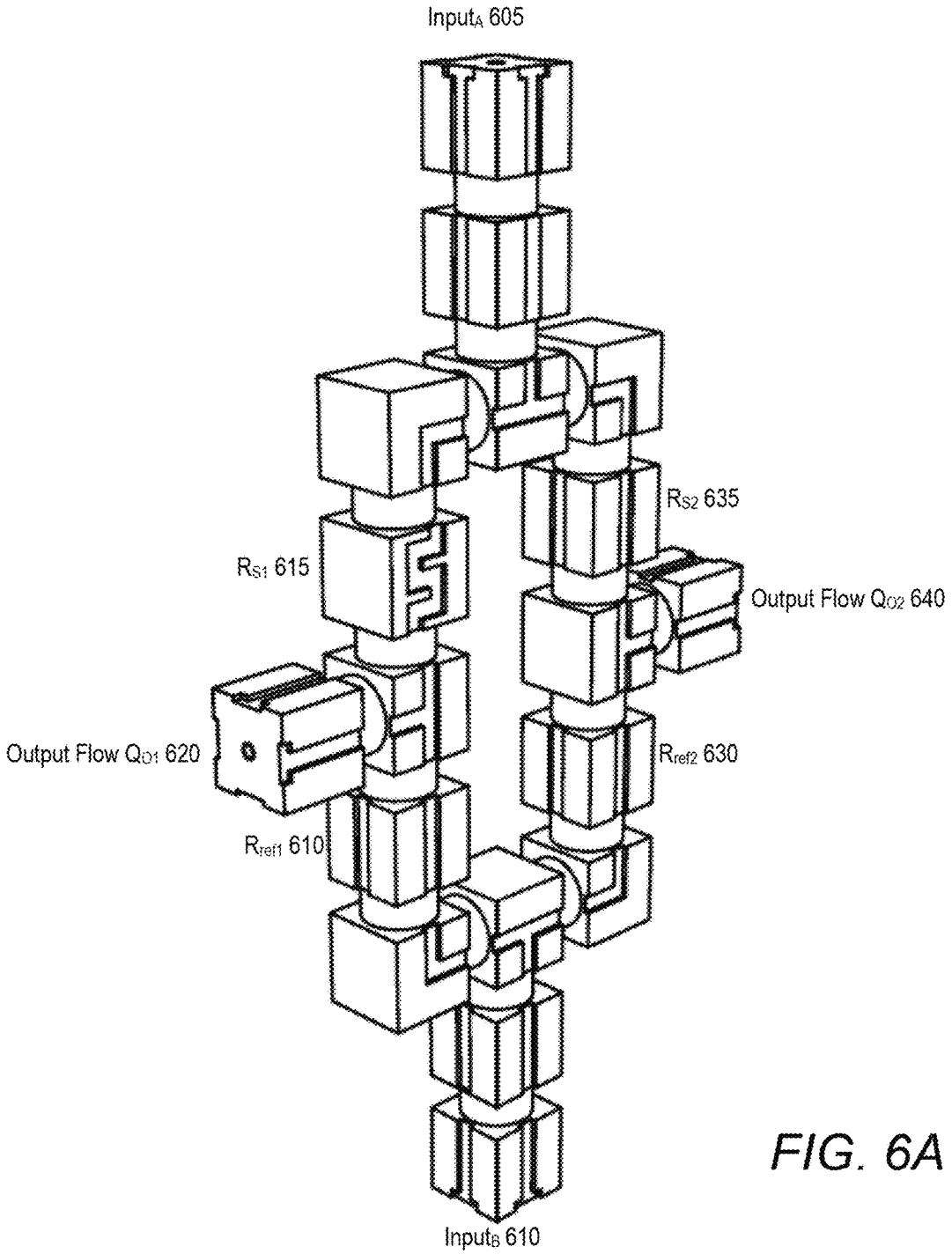
FIG. 6A illustrates an example of two single-outlet subcircuits combined to parallelize operation of a tunable mixer to yield a two-outlet device.

FIG. 6A illustrates an example of two single-outlet subcircuits combined to parallelize operation of a tunable mixer to yield a two-outlet device. In particular, the two single-outlet subcircuits are both structured similarly to the gradient generator device of FIG. 4A and FIG. 4B. The two-outlet device of FIG. 6A includes a $R_{s1}$ 615 and a $R_{ref1}$ 610 at the two branches of the left-side subcircuit (mixing input A 605 and input B 610 and outputting output flow $Q_{O1}$ 620), and a $R_{s2}$ 635 and a $R_{ref2}$ 630 at the two branches of the right-side subcircuit (mixing input A 605 and input B 610 and outputting output flow $Q_{O2}$ 640).

While $R_{s1}$ 615 is illustrated as a mixer module 340 (which may behave as a resistor by including, for example, a narrowed and/or longer winding channel pathway that takes longer for fluid to traverse), $R_{s2}$ 635 is instead illustrated as a straight pass module 330. A straight pass module 330 (or any other non-mixer module, such as an L-junction or a T-junction) may have an increased resistance by, for example, narrowing the module channel within the module, introducing "turning" or "winding" or "spiraling" portions of the module channel to lengthen the module channel, or by partially occluding the module channel within the module (e.g., by filling at least part of it with a porous solid). The resistance of a mixer module 340 may similarly be increased with narrowness of the channel, increasing the length of the channel as specified above, or partially occluding the channel as specified above. Different embodiments may use a different combination of different types of resistors.

Figure 6B:
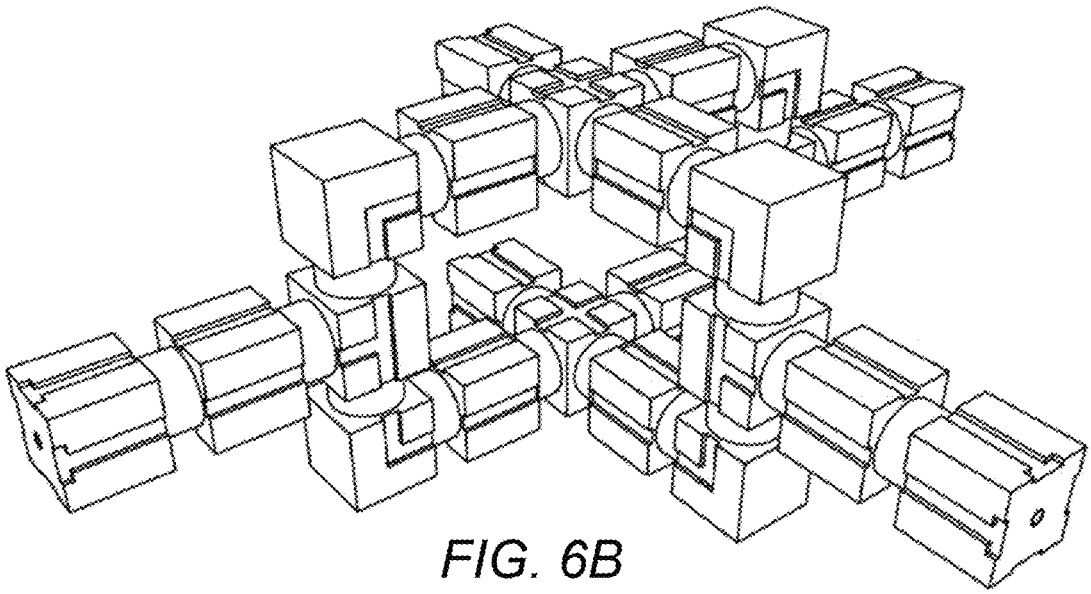
FIG. 6B illustrates an example of three single-outlet subcircuits combined to parallelize operation of a tunable mixer to yield a three-outlet device.

FIG. 6B illustrates an example of three single-outlet subcircuits combined to parallelize operation of a tunable mixer to yield a three-outlet device.

Figure 6C:
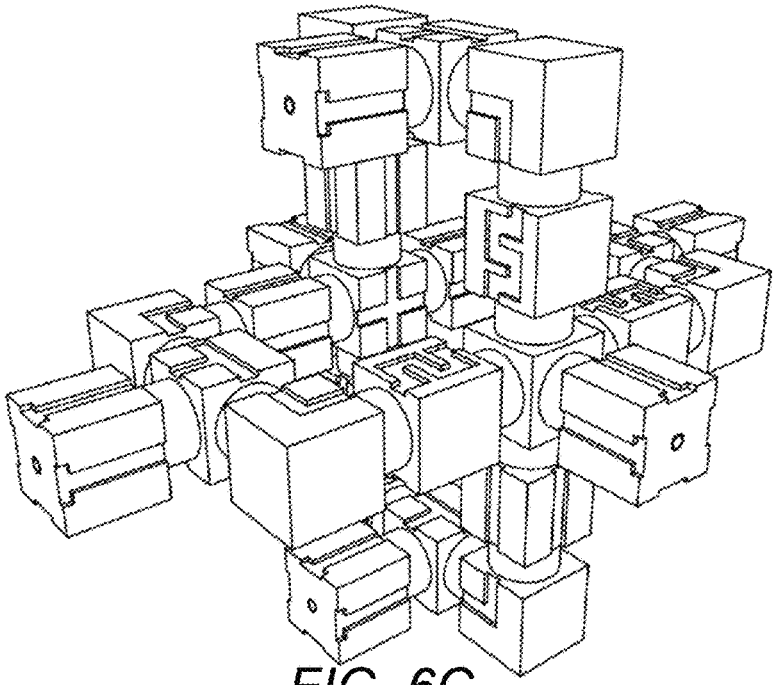
FIG. 6C illustrates an example of four single-outlet subcircuits combined to parallelize operation of a tunable mixer to yield a four-outlet device.

FIG. 6C illustrates an example of four single-outlet subcircuits combined to parallelize operation of a tunable mixer to yield a four-outlet device.

As illustrated by FIG. 6A, FIG. 6B, and FIG. 6C, the operational principles of the microfluidic circuit of FIG. 4A and FIG. 4B may be expanded by using it as a module in two, three, and four outlet, large-scale tunable mixers by adding or replacing T-, X-, and XT-junctions near the reservoir inlets. In this manner, the symmetry of the device around a single axis through which input streams are split may be maintained, such that the structural resistance in each new single outlet sub-circuit is unchanged between configurations.

Figure 7A:
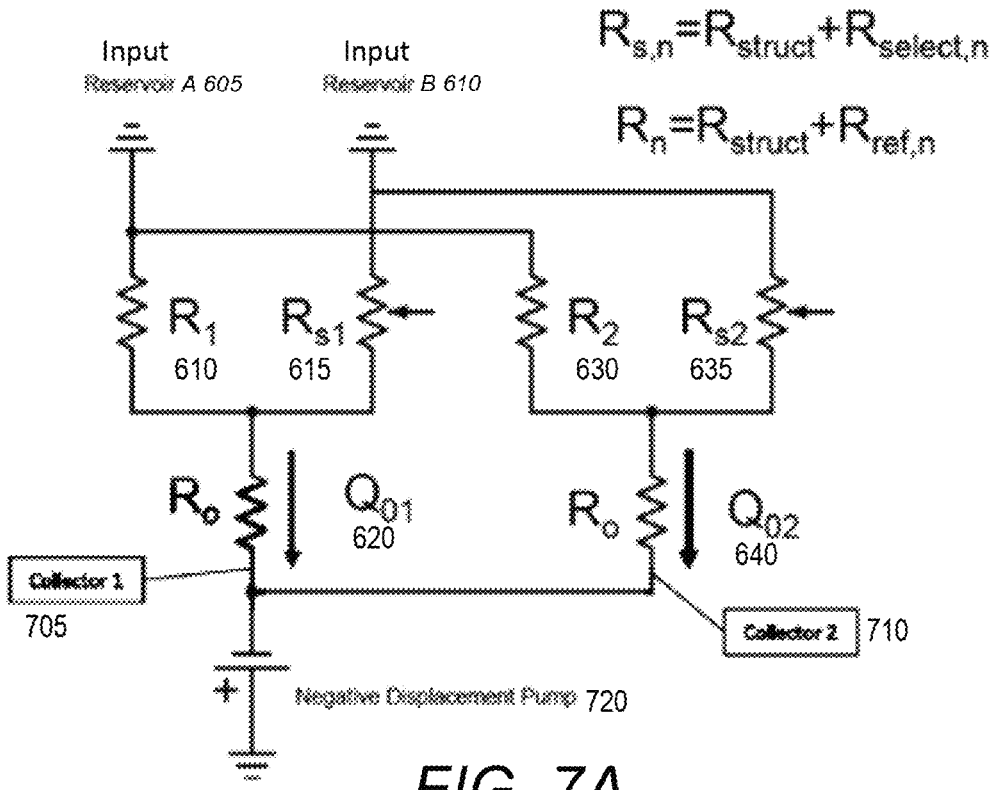
FIG. 7A illustrates the two-outlet device of FIG. 6A in symbolic circuit notation.

FIG. 7A illustrates the two-outlet device of FIG. 6A in symbolic circuit notation. The symbolic circuit notation of FIG. 7A illustrates that the output flow $Q_{O1}$ 620 is collected at a Collector 1 705, and that the output flow $Q_{O2}$ 640 is collected at a Collector 2 710. The mechanism may be driven by a negative displacement pump 720 connecting the two output flow blocks (not shown in FIG. 6A).

Figure 7B:
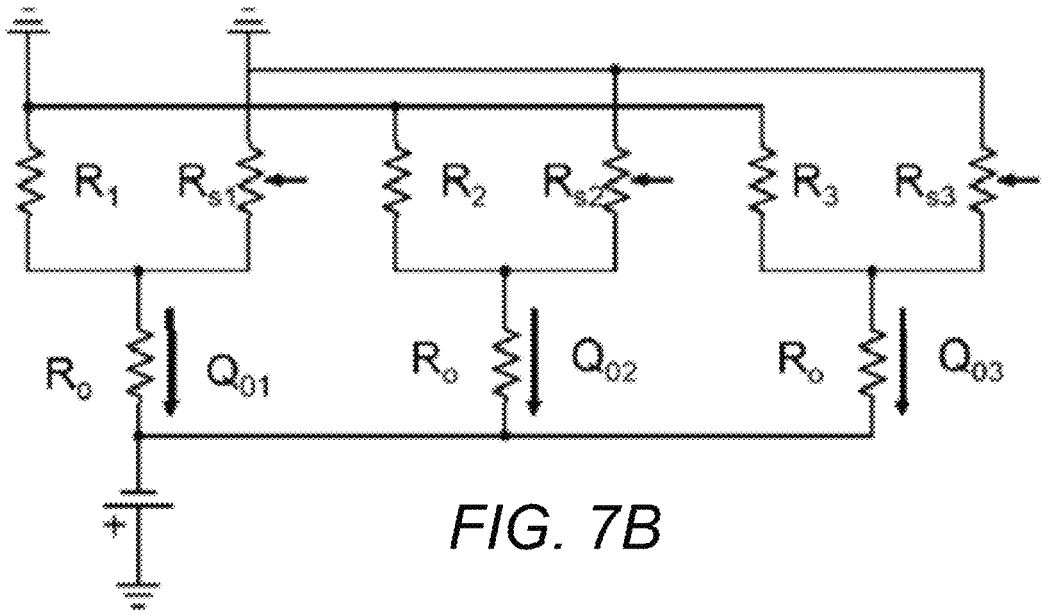
FIG. 7B illustrates the two-outlet device of FIG. 6B in symbolic circuit notation.

FIG. 7B illustrates the two-outlet device of FIG. 6B in symbolic circuit notation.

Figure 7C:
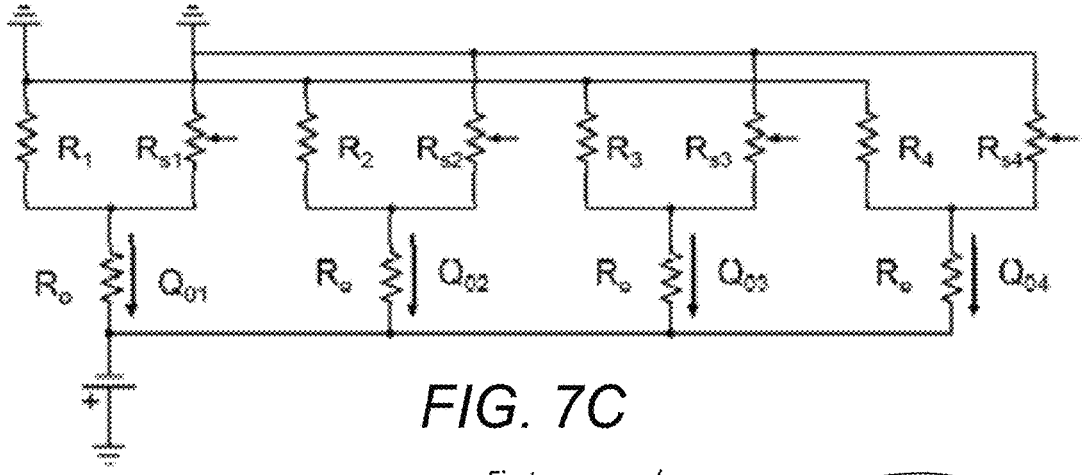
FIG. 7C illustrates the two-outlet device of FIG. 6C in symbolic circuit notation.

FIG. 7C illustrates the two-outlet device of FIG. 6C in symbolic circuit notation.

FIG. 7A, FIG. 7B, and FIG. 7C, each illustrates an example of an equivalent circuit diagram for the module assemblies illustrated in FIG. 6A, FIG. 6B, and FIG. 6C, respectively. In a planar setting, this control over parallelization of operation may be impossible due to the need for extra structural modules in order to connect these sub-circuits to the inlets. By driving this circuit with a constant pressure source (e.g., the negative displacement pump 720 of FIG. 7A or similar negative displacement pumps at FIG. 7B and FIG. 7C), each sub-circuit can be analyzed as a unit with a mixing ratio which is independently controlled by its corresponding branch resistance ratio, as seen in the equivalent circuit diagrams in FIG. 7A, FIG. 7B, and FIG. 7C.

Configurability: Microdroplet Generation

In addition to being straightforward to analyze in terms of element-by-element hydrodynamics, modular microfluidic systems may offer the advantage of simple reconfigurability. The ability to rapidly assemble and modify two common microfluidic circuit topologies used to generate droplets was demonstrated: T-junction and flow-focus (see Choi S, Lee M G, Park J-K, Biomicrofluidics, 2010, hereby incorporated by reference, for a review of these methods).

Figure 8:
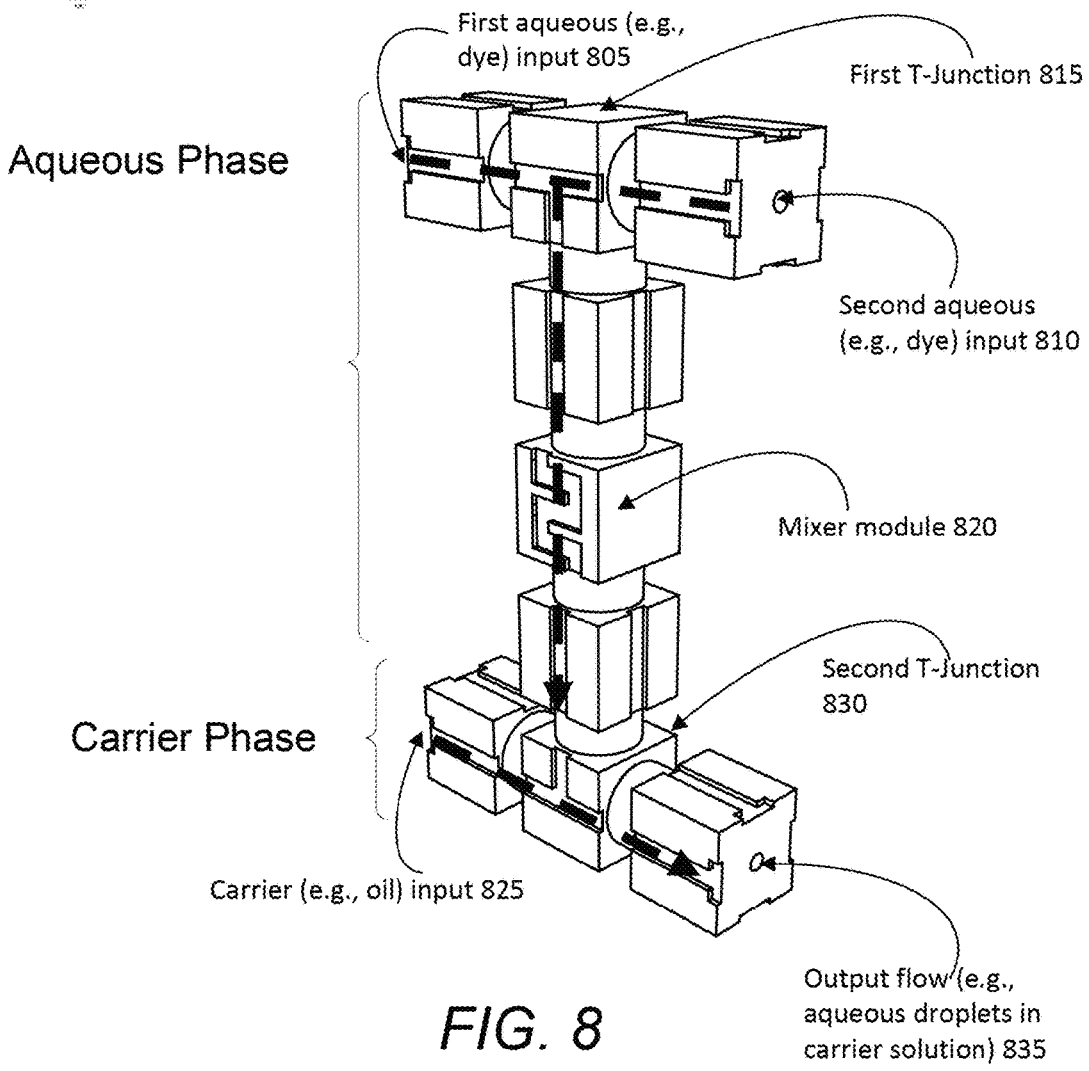
FIG. 8 illustrates an exemplary T-junction emulsification circuit.
Figure 11A:
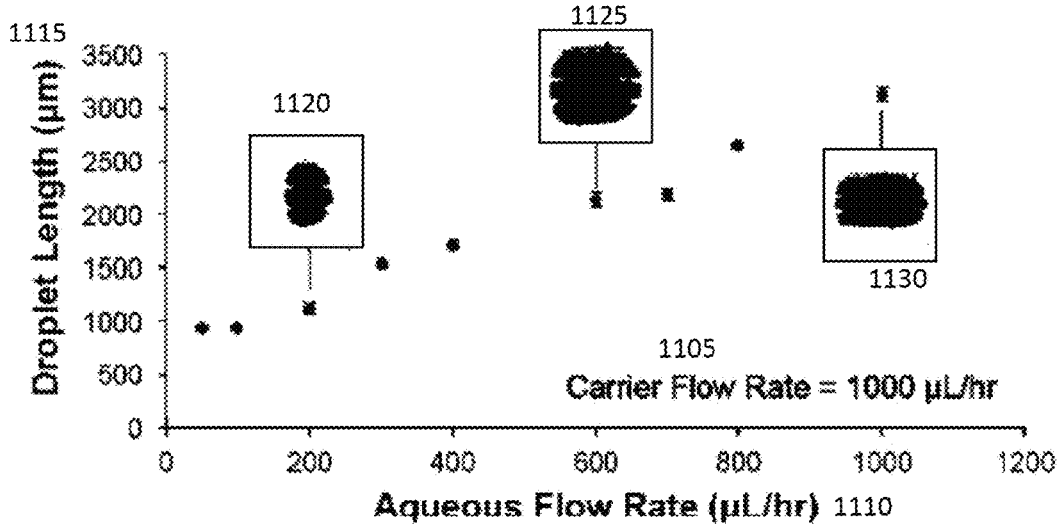
FIG. 11A illustrates an example of droplet length measurements, measured along the center axis of exit tubing, for the T-junction emulsification circuit of FIG. 8.

FIG. 8 illustrates an example of a T-junction emulsification circuit. In the T-junction configuration illustrated in FIG. 8, a single syringe pump (e.g., a negative displacement pump located past the output flow 830) may be used to drive two dye-bearing water streams (e.g., first dye input 805 and second dye input 810) into the circuit where they may be combined (e.g., at the first T-junction 815), mixed (e.g., at the mixer module 820), and emulsified (e.g., at the second T-junction 830) in a carrier (e.g., oil) stream (e.g., from carrier input 825) before being output at output flow 830. The result of the T-junction emulsification circuit of FIG. 8, at the right flow rates, is to "cut" the aqueous flow at the second T-junction 830 so that the output flow 830 is output as droplets of the aqueous solution instead of as a steady stream of the aqueous solution. The droplets are output in the output flow 830 along with the carrier, which may be oil. Example results of the T-junction emulsification circuit of FIG. 8 are illustrated in FIG. 11A.

If the mixer module 820 has a helical channel portion, it may in some cases lose effectiveness at aqueous flow rates above 2.5 milliliters per hour (mL $hr^{-1}$), determining the upper bound for the aqueous phase sub-circuit operation. The carrier phase flow rate may in this case be held constant at 1 mL $hr^{-1}$, while the aqueous phase flow rate may be varied, resulting in well-defined steady-state control of droplet size down to sub-millimeter sizes.

Figure 9:
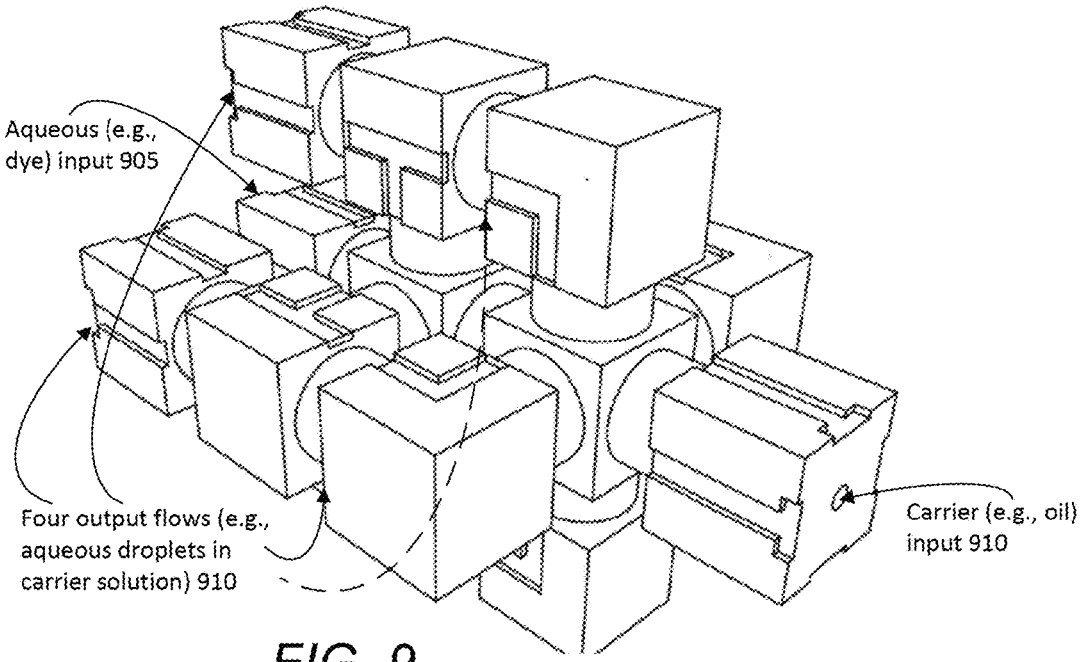
FIG. 9 illustrates an example of four-outlet T-junction emulsification circuit.

FIG. 9 illustrates an example of a four-outlet T-junction emulsification circuit built in three dimensions. As illustrated in FIG. 9, a 3-dimensional quad-outlet version of the T-junction sub-circuit (the T-junction emulsification circuit of FIG. 8) may be constructed in order to parallelize operation for high-throughput applications.

A single aqueous input (e.g., coupled to a dye or non-oil liquid reservoir) 905 may be is located in the center of the left side of the circuit illustrated in FIG. 9, while a single carrier input (e.g., coupled to an oil reservoir) 910 may be located on the right side of the circuit illustrated in FIG. 9. The four output flows may produce aqueous droplets in an oil solution as described in relation to FIG. 8, and may be located in a "plus symbol" configuration around the aqueous input 905.

The carrier and aqueous phases may each be split into four streams with cylindrical symmetry around an inlet axis through which they are introduced. Each new stream may radially be transported away from the axis, and intersected with its immiscible counterpart in T-junctions arranged around the axis. This "equal path-length distribution" method may be similar to that demonstrated in parallelizing operation of the tunable mixer circuit described above.

Figure 10:
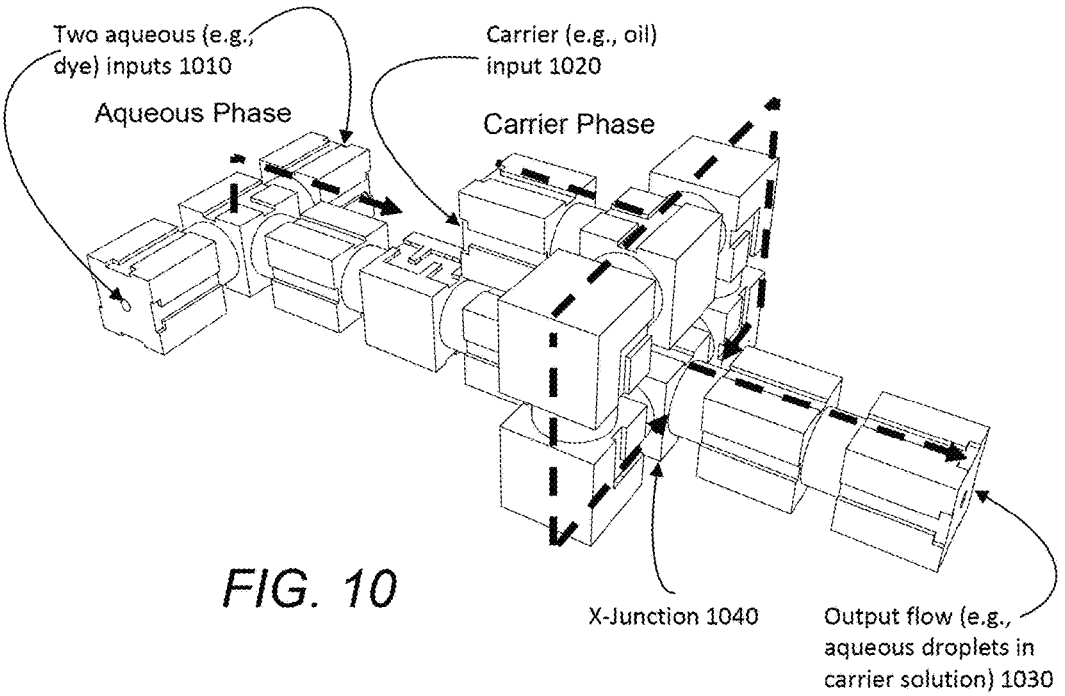
FIG. 10 illustrates an example of a flow-focus configuration emulsification circuit.

FIG. 10 illustrates an example of a flow-focus configuration emulsification circuit. The potential to produce even smaller droplets while leveraging the ability to construct three-dimensional systems may be demonstrated by replacing the T-junction sub-circuit with a flow-focus sub-circuit. The input carrier stream assembly may be built around the aqueous phase flow axis (which may include two aqueous inputs 1010) such that carrier phase (with the carrier introduced via carrier input 1020) is as transported vertically down into an X-junction 1040 where droplets are formed. The aqueous phase flow rate may be varied once again and the carrier phase flow rate may be raised to 5 mL $hr^{-1}$ in order to prevent droplet coalescence in the connector channels near the outlet. Example results of the flow-focus configuration emulsification circuit of FIG. 10 are illustrated in FIG. 11B.

FIG. 11A illustrates an example of droplet length measurements, measured along the center axis of exit tubing, for the T-junction emulsification circuit of FIG. 8. The droplet length measurements are taken using a constant carrier flow rate 1105 of 1000 microliters per hour. The droplet length (vertical axis 1120) visibly increases as the aqueous flow rate (horizontal axis 1110) increases. Several dark-colored aqueous droplets are shown in light-colored carrier solutions. For example, droplet 1130, measured at an aqueous flow rate of approximately 1000 milliliters per hour, is noticeable larger than droplet 1125, which was measured at an aqueous flow rate of approximately 600 milliliters per hour, and which is noticeably larger than droplet 1120, which was measured at an aqueous flow rate of approximately 200 milliliters per hour.

Figure 11B:
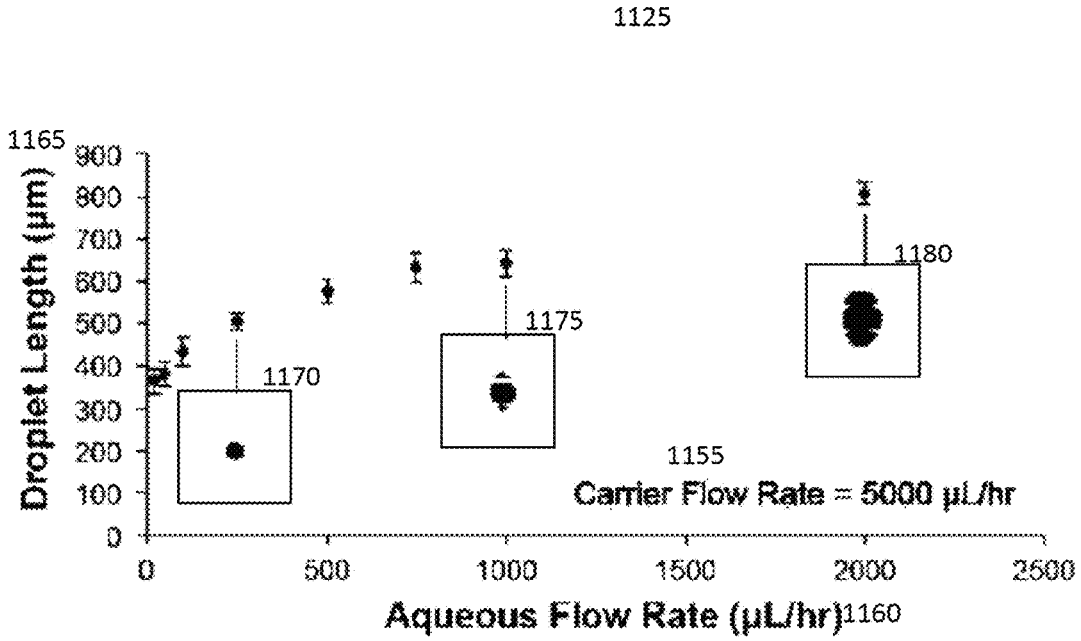
FIG. 11B illustrates an example of droplet length measurements, measured along the center axis of exit tubing, for the flow-focus configuration emulsification circuit of FIG. 10.

FIG. 11B illustrates an example of droplet length measurements, measured along the center axis of exit tubing, for the flow-focus configuration emulsification circuit of FIG. 10. The droplet length measurements are taken using a constant carrier flow rate 1155 of 5000 microliters per hour. The droplet length (vertical axis 1165) visibly increases as the aqueous flow rate (horizontal axis 1160) increases. Several dark-colored aqueous droplets are shown in light-colored carrier solutions. For example, droplet 1180, measured at an aqueous flow rate of approximately 2000 milliliters per hour, is noticeable larger than droplet 1175, which was measured at an aqueous flow rate of approximately 1000 milliliters per hour, and which is noticeably larger than droplet 1170, which was measured at an aqueous flow rate of approximately 250 milliliters per hour.

Ultimately, then, both the circuit of FIG. 8 and the circuit of FIG. 10 were measured optically and shown to reliably depend on the ratio of aqueous and carrier phase flow rates.

Versatility: In-Situ Monitoring of Micro-Droplet Generation

Active elements may be incorporated into the modular packaging described herein by building sensors and actuators into the stereo-lithographically fabricated parts.

Figure 12A:
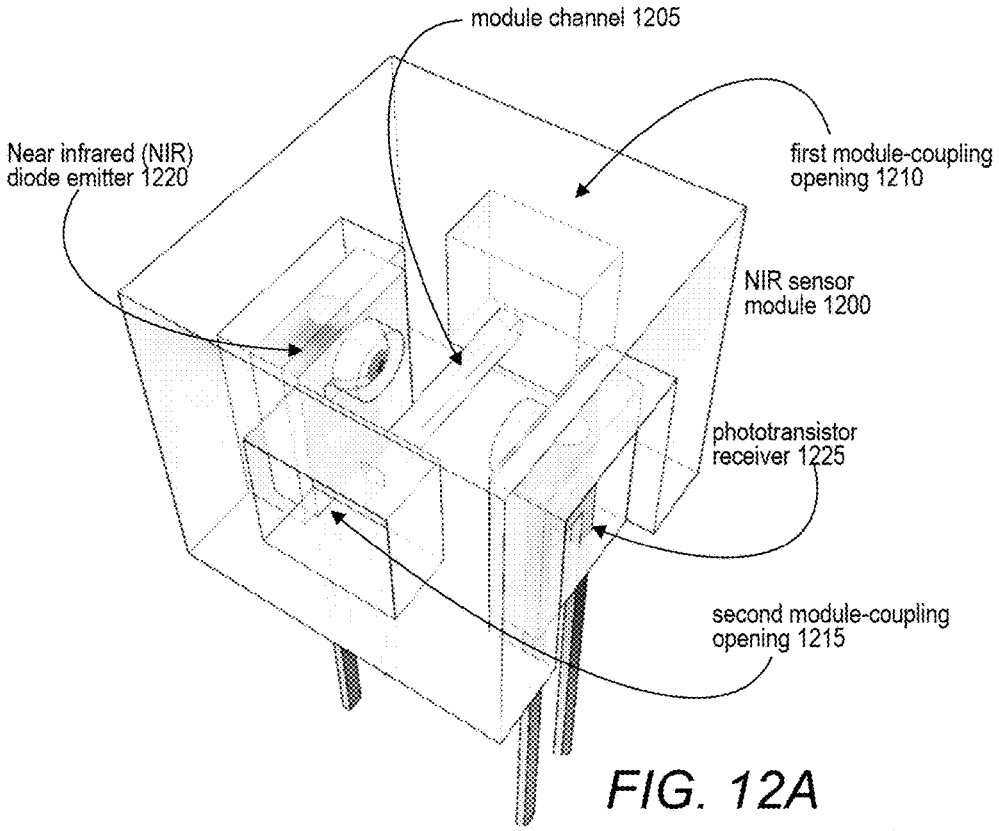
FIG. 12A illustrates an example of a module with a straight pass channel intersecting the bream created between a discrete near infrared (NIR) diode emitter to a phototransistor receiver.
Figure 12B:
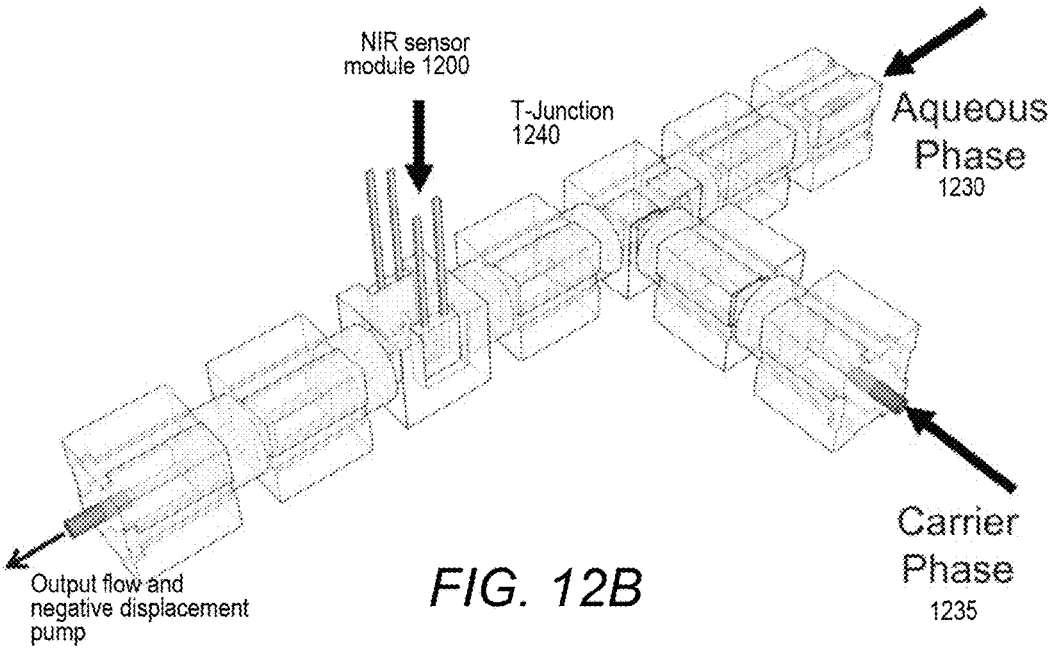
FIG. 12B illustrates an example of an assembly where the near infrared (NIR) sensing module of FIG. 12A is placed downstream from a T-junction producing droplets that absorb the near infrared (NIR) beam as they cross its path.

FIG. 12A illustrates an example of a module with a straight pass channel intersecting the bream created between a discrete near infrared (NIR) diode emitter to a phototransistor receiver. As illustrated in FIG. 12A, an off-the-shelf, near-infrared (NIR) emitter 1220 and phototransistor receiver 1225 pair may be incorporated into a module 1200 designed for droplet sensing. The module 1200 may be designed such that the diode 1220 and phototransistor receiver 1225 fit snugly into embossed features on the exterior of the 1200, creating a beam path that intersects a straight pass channel element 1205. The channel may carry water droplets dispersed in a fluorocarbon oil phase formed by an upstream T-junction circuit, as illustrated in FIG. 12B. Such an NIR sensor could also be embedded in a different type of module, such as an L-joint 335, a mixer 340, a T-junction 345, or an interface module 355. In other cases, other electromagnetic frequencies (e.g., radio, microwave, infrared, visible light, ultraviolet) may be used in a similar sensor.

Figure 12C:
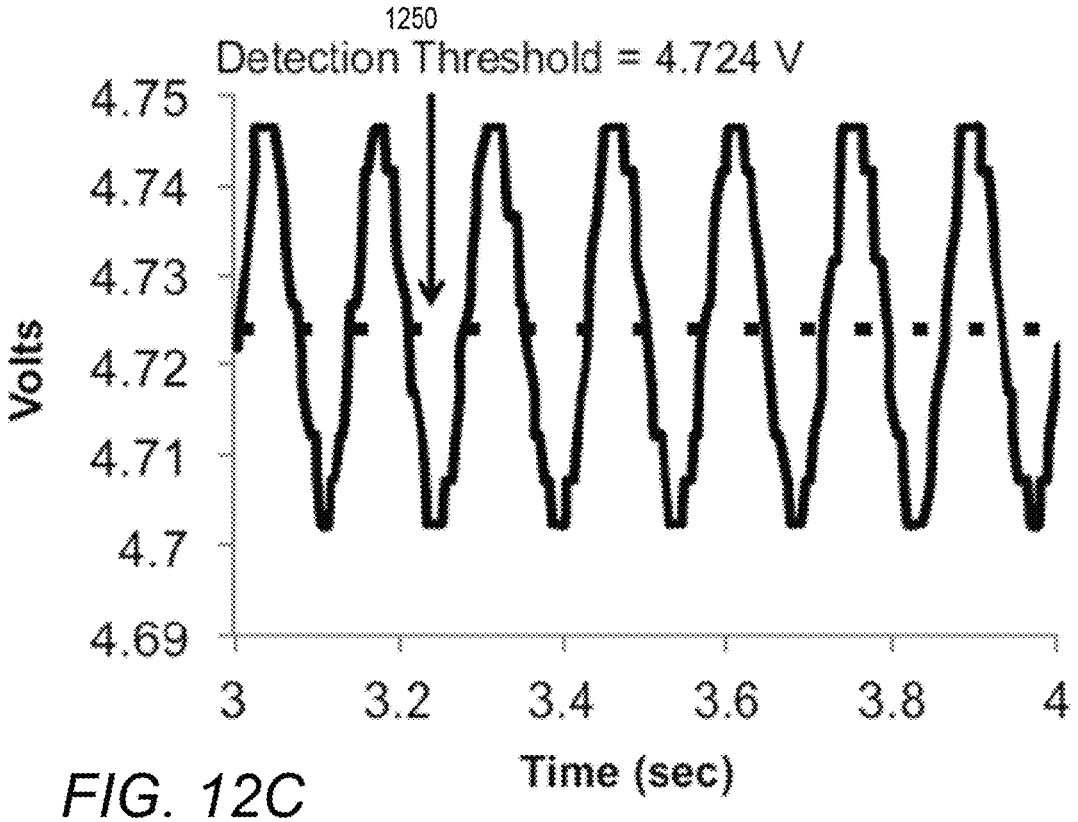
FIG. 12C illustrates an example of a periodical signal generated by the output of the phototransistor receiver in FIG. 12A.

FIG. 12B illustrates an example of an assembly where the near infrared (NIR) sensing module of FIG. 12A is placed downstream from a T-junction producing droplets that absorb the near infrared (NIR) beam as they cross its path. The droplets may be an aqueous solution 1230 in a carrier solution 1235 joining at T-junction 1240 before a measurement is taken by the phototransistor receiver 1225 of the NIR sensor module 1200. The channel may carry, for example, water droplets dispersed in a fluorocarbon oil phase formed by an upstream T-junction 1240 of the circuit of FIG. 12B, FIG. 12C illustrates an example of a periodical signal generated by the output of the phototransistor receiver in FIG. 12A. For example, the phototransistor receiver 1225 of the module 1200 may reach a detection threshold 1250 of 4.724 volts, which may indicate a particular droplet length detected by the phototransistor receiver 1225. An exemplary electronic circuit whose output may correspond to the signal of FIG. 12C is illustrated in FIG. 13.

Figure 12D:
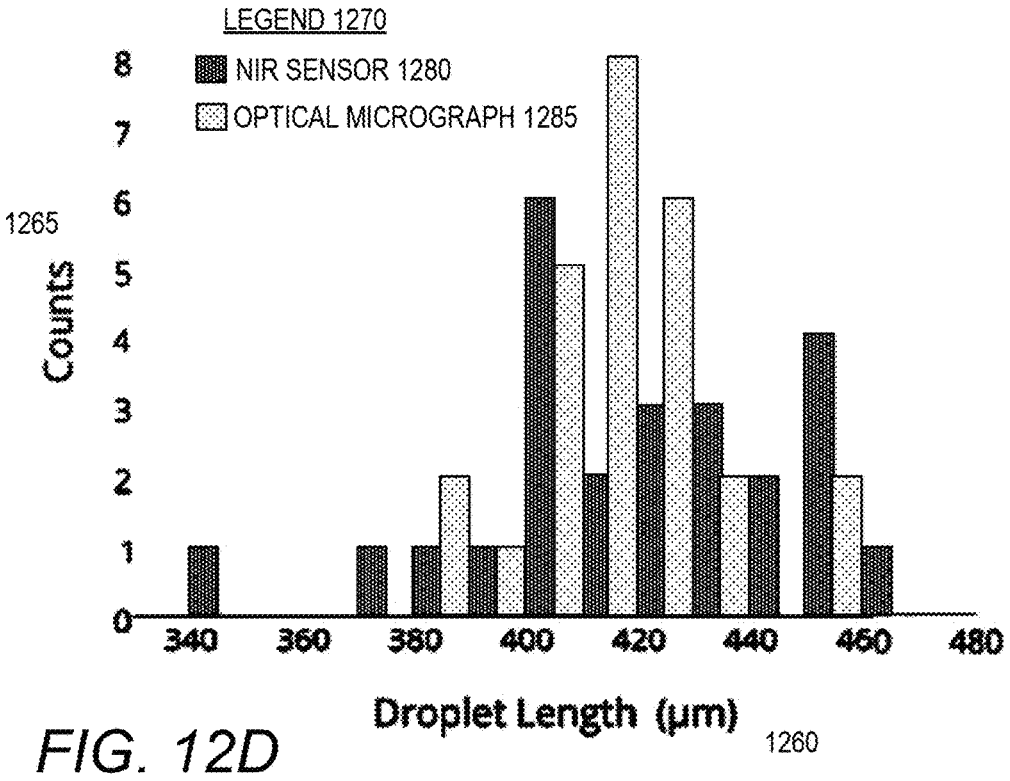
FIG. 12D illustrates an example of droplet length measurement distribution as determined by an near infrared (NIR) sensor and through optical measurements.

FIG. 12D illustrates an example of droplet length measurement distribution as determined by an near infrared (NIR) sensor and through optical measurements. In particular, the graph of FIG. 12D charts a count (along a vertical axis 1265) of how many droplets of a sample of multiple droplets, as measured by an NIR sensor 1280 (e.g., by the phototransistor receiver 1225) of a module 1200, were detected at each of a number of various droplet lengths (along the horizontal axis 1260). These NIR counts are compared on the chart with a count (along a vertical axis 1265) of how many droplets of the sample, as measured by an optical micrograph 1285, were detected at each of a number of various droplet lengths (along the horizontal axis 1260). The comparison (see legend 1270) indicates that the results are similar.

Figure 13:
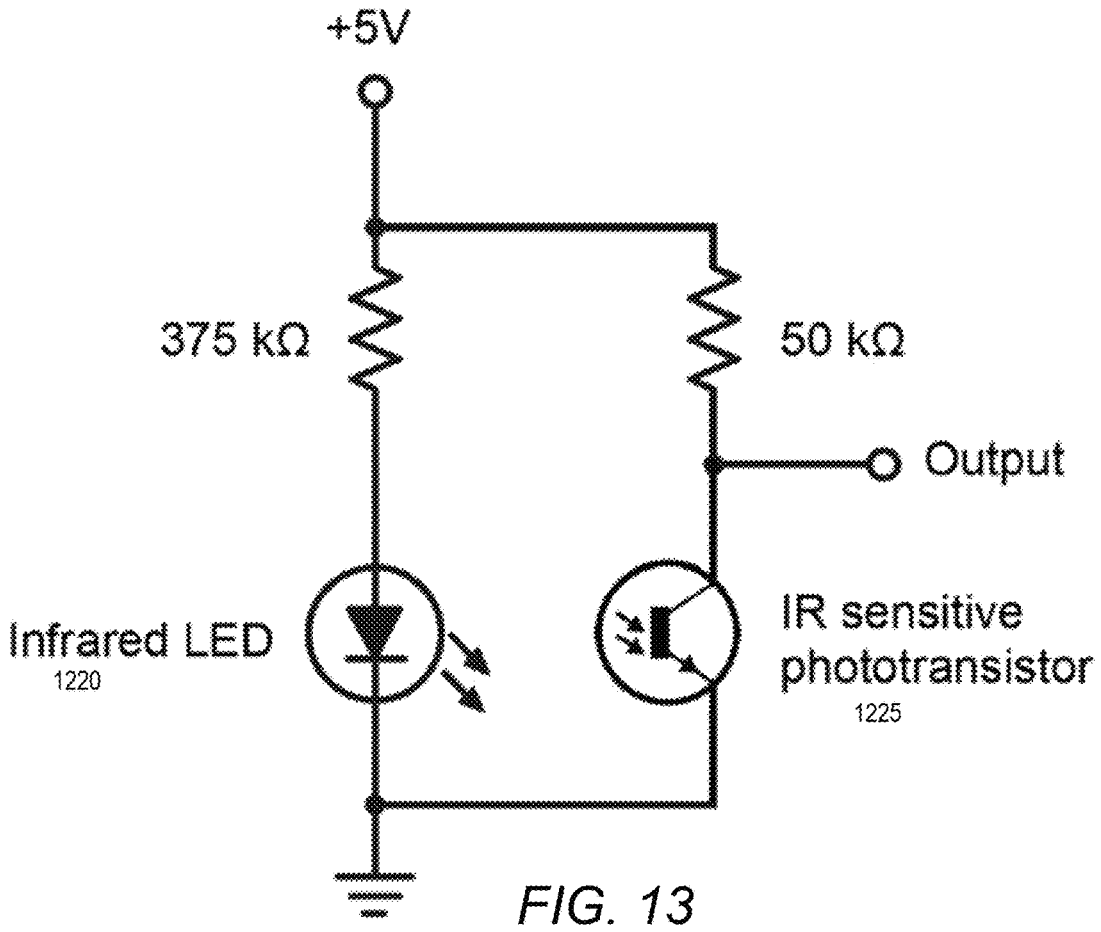
FIG. 13 illustrates an example of an electrical circuit diagram depicting the operation of the near-infrared droplet measurement element.

FIG. 13 illustrates an example of an electrical circuit diagram depicting the operation of the near-infrared droplet measurement element. The voltage signal across the NPN phototransistor detector 1225 biased in saturation mode may be monitored. As droplets of water cross the beam, they may absorb the near-infrared light from the infrared (and/or near infrared) light emitting diode (LED) 1220 much more than the carrier oil. The resulting signal may be digitized and communicated to a computer device by a microcontroller in order to determine the droplet production frequency.

The length of the droplets may be deduced from the average flow velocity in the channel and half-period of the signal (i.e. the droplet residence time in the beam), and compared directly with droplet sizes measured by optical microscopy. The results show good agreement between the two techniques. They suggest that, by incorporating more market-available discrete electronic devices into the modules, active process monitoring and feedback control systems can be implemented with ease.

Manufacturing and Post-Processing

Modifying the surface properties of the channels may be performed by coating them with a fluoropolymer coating via a vapor-phase technique for modifying channels in PDMS devices in a laboratory. Such techniques may be used to coat an inner surface of a module channel to produce different surface energies, hydrophobic properties, or other effects.

For example, a surface containing a water droplet surrounded by oil on an uncoated surface may have a higher contact angle (e.g., over 90 degrees and relatively flat against the surface) than water droplet surrounded by oil on a coated surface, which may have a relatively low contact angle (e.g., lower than 90 degrees and jutting away from the surface). Coating the surface of a channel may thus produce effective modification of the channel hydrophobicity by initiated chemical vapor deposition. Initiated chemical vapor deposition (iCVD) may be used to coat the channels in stereo-lithographically fabricated modules with poly(1H, 1H,2H,2H-perfluorodecyl acrylate-co-ethylene glycol diacrylate), making the channel walls hydrophobic and increasing the contact angle of a water droplet in oil (e.g., from 67.9° to 138.3°). Such a coating need not affect the optical clarity of the photoresin material of channels and/or modules and/or connectors.

In addition to reversible assembly techniques (e.g., the male coupling pins and female coupling ports illustrated in FIG. 1A), several approaches to permanently or semi-permanently coupling multiple modules may be used. These approaches may be mechanical, thermal, or chemical in nature, and may produce varying coupling durabilities. For example, two modules may be coupled (with or without a connector 325) using fast-curing epoxy or silicone pipe sealant via direct application with a cotton tipped applicator. A microfluidic circuit may also be potted by connecting interface modules to breather tubes, completely immersing the assembly in PDMS, and curing it at a predetermined high temperature (e.g., approximately 30° C.) for a predetermined amount of time (e.g., approximately 24 hours).

Thermal Sensing

A variety of sensors may be integrated in this system beyond the NIR emitter-receiver pair described above.

Figure 14:
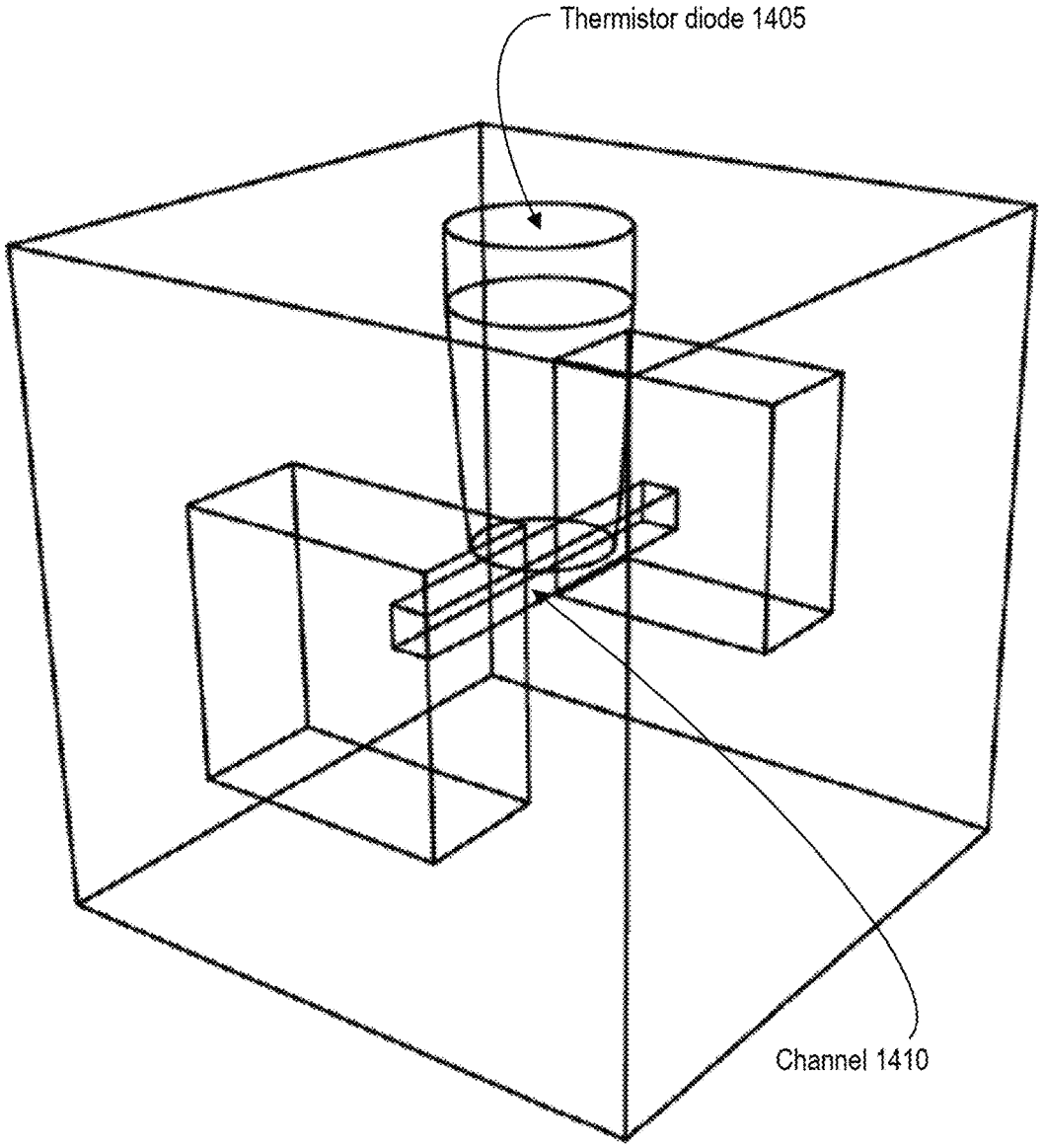
FIG. 14 illustrates an exemplary thermal sensing module where the channel coming in from the top surface can house an off-the-shelf thermistor diode.

FIG. 14 illustrates an example of a thermal sensing module where the channel coming in from the top surface can house an off-the-shelf thermistor diode 1405. In FIG. 14, a market-available glass bead thermistor 1405 is configured to make contact with a microfluidic flow through a channel 1410 and therefore measure the temperature of the microfluidic flow. The sensor 1405 may, for example, be calibrated for flow-rate dependent behavior and is presumed to read the temperature of the flow within the accuracy specified by a thermistor data sheet corresponding to the thermistor 1405.

Magnetic Actuation

Figure 15:
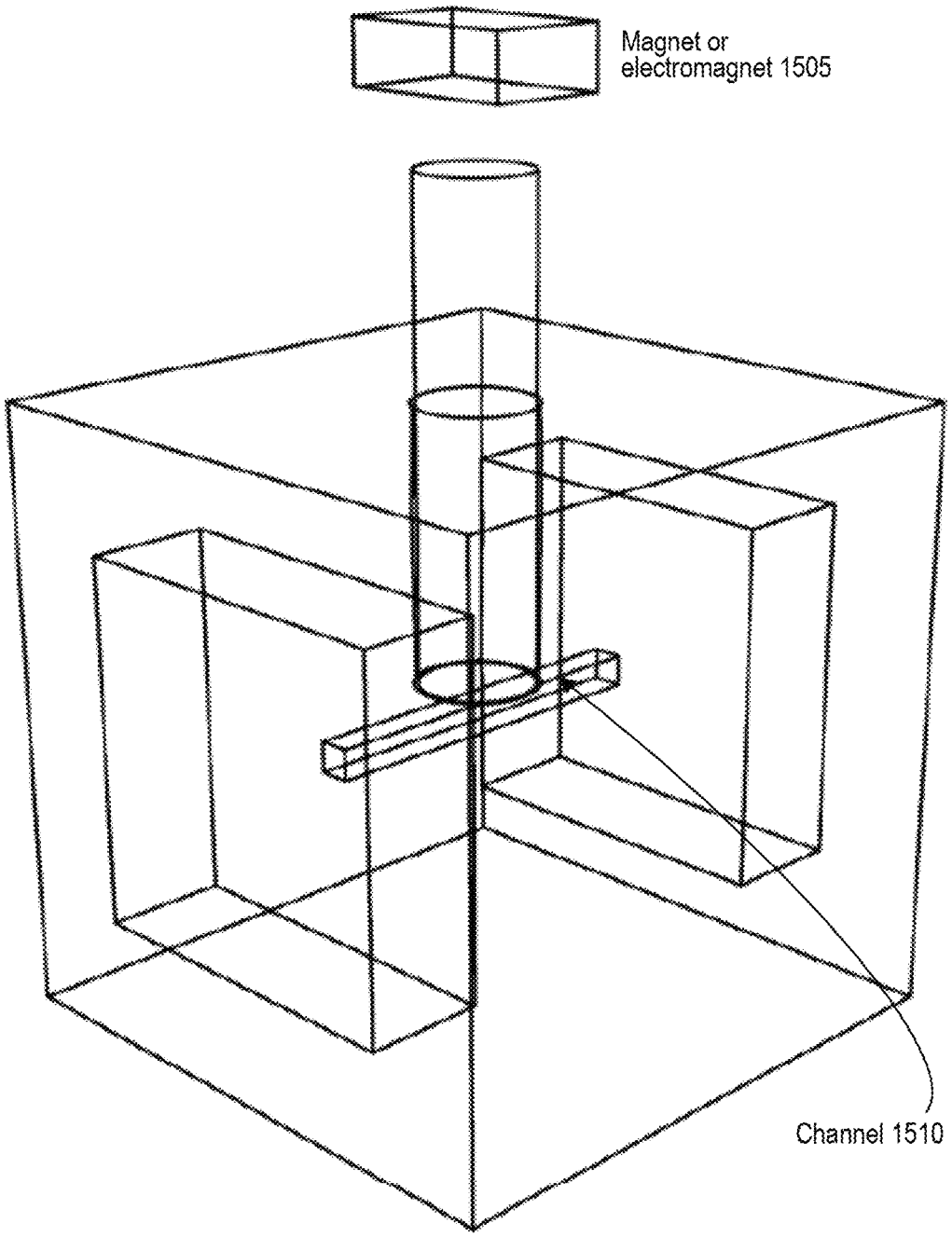
FIG. 15 illustrates an example of a magnet integrated into a module, which may be used in conjunction with micron scale paramagnetic beads.

FIG. 15 illustrates an example of a magnet integrated into a module. In applications in biochemistry, micron scale paramagnetic beads (not shown) may be introduced to different compounds (e.g., a fluid flowing through channel 1510) in order to provide a removable substrate for surface chemistries to occur. In other words, the magnetic beads can be introduced to different reagents and withdrawn using a magnet 1505 (e.g., a permanent magnet or an electromagnet). In this system, magnetic beads in microfluidic flows can be actuated to transfer from one reagent to another in a module with a local magnet or electromagnet, as shown in FIG. 15. This may be used to detect a particular compound within a fluid by introducing the reagent to magnetic beads, removing the beads after a fluid has passed through channel 1510, and detecting reactions from the reagents after removal of the magnetic beads.

Valve Actuation

Figure 16:
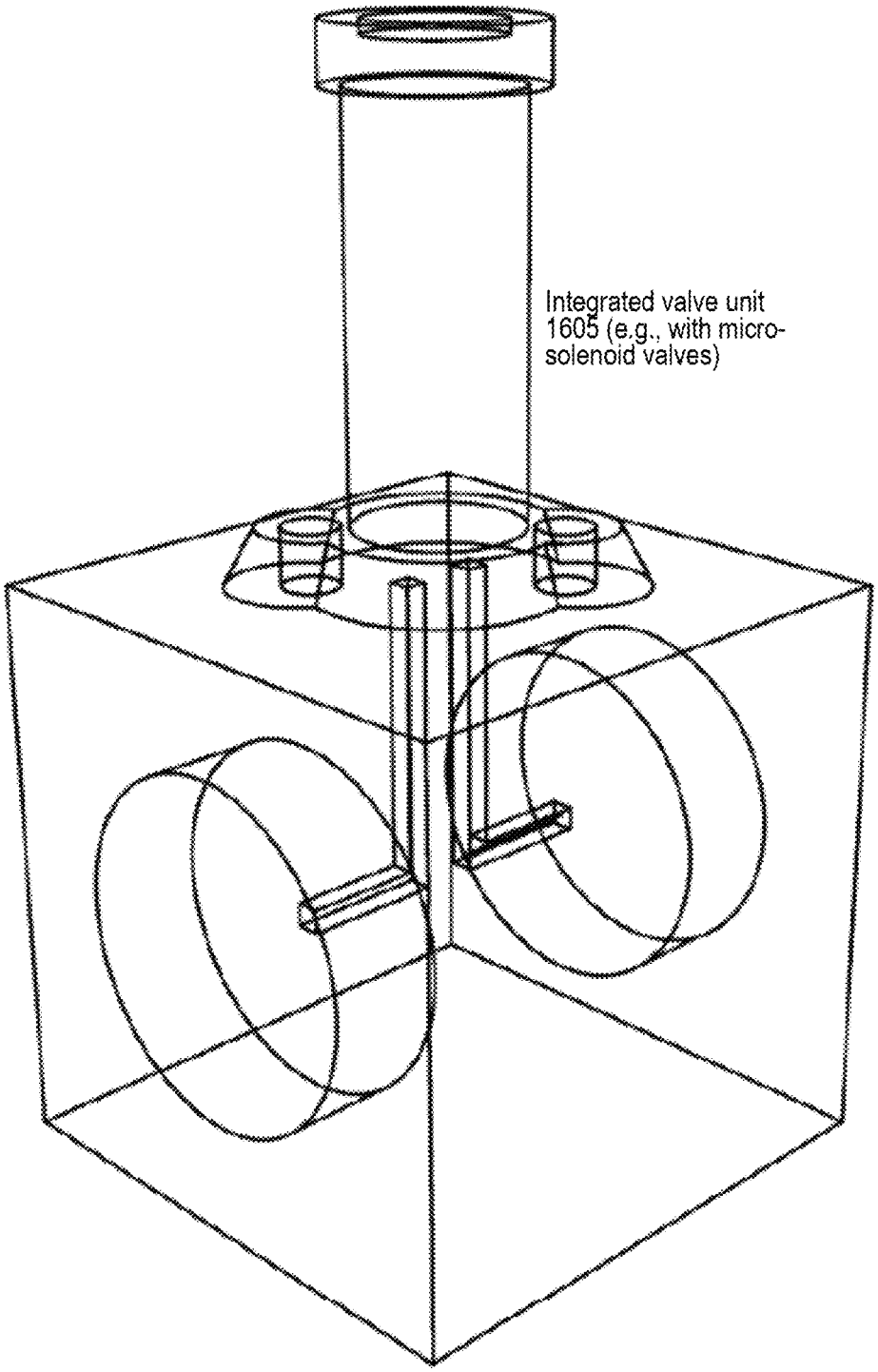
FIG. 16 illustrates an example of a module with an integrated valve unit.

FIG. 16 illustrates an example of a module with an integrated valve unit. Controlling fluid flows may be accomplished through specialized modules of the integrated valve unit 1605 with micro-solenoid valves integrated directly into the module framework, as shown in FIG. 16.

Further Examples

A robust solution for the rapid bench-top assembly of three-dimensional microfluidic systems from a library of standardized discrete elements is described herein. Modules may be fabricated using additive manufacturing methods and characterized by their terminal flow characteristics. This may enable the use of circuit theory to accurately predict the operation of a microfluidic mixing system with scalable complexity in three dimensions. The assembly time (from part selection to initial testing) for a complex system can be less than one hour. In addition to being much faster to prototype than monolithic devices, this system may also allow for three-dimensional configurations which were not previously possible using older technologies.

By discretizing and standardizing the primitive elements comprising such systems, newly found design complexity may naturally allow for hierarchal system analysis techniques borrowed from the hydraulic analogy to electronic circuit design. In turn, this may allow the designer to focus more on satisfying a dynamic set of operational load requirements, rather than working within the restrictively static environment of planar manufacturing.

The ability to reconfigure these systems towards expanded operational capabilities may be further demonstrated by attaching three emulsification sub-circuit modules to a simple mixing circuit in order to form droplets over a wide range of volumes and generation rates. Despite less need for analytically predictable operation, piecewise validation may also be shown for these canonical two-phase flow systems by qualifying the mixer sub-circuits and then in turn the emulsifier sub-circuits for functionality. In a monolithic device, each of the circuits demonstrated may comprise a single system prone to complete failure due to singular manufacturing error or design error of a single element. In the systems described in this disclosure, modules in circuit assembly may be quickly assessed for their independent contribution to failure and replaced or modified accordingly. After successful test and validation, the devices may optionally be sealed into permanent configurations while maintaining their optical clarity and ease of interfacing.

The operational performance of one of these circuits may be monitored by including a single active module capable of performing in-situ sensing. The ability to reconfigure this system may thus also be advantageous from the standpoint of metering systems before finalization of a design. In addition, the inclusion of active sensing modules may be particularly advantageous when considering process monitoring in highly complex systems with many sub-circuits: densely routed microfluidic systems may not integrate well into standard analysis tools such as optical microscopes.

The modules and channels described herein, and the arrangements that can be made using them, can make discrete microfluidics a valuable development vehicle for a complex design that has not yet been achieved. With a wider library of passive and active modules to choose from, this system can replace monolithically integrated devices for many microfluidic applications. In addition, this system may benefit immensely as industrial additive manufacturing technologies also improve, allowing for the further miniaturization of elements and development of an even larger selection of elements and materials.

Figure 17A:
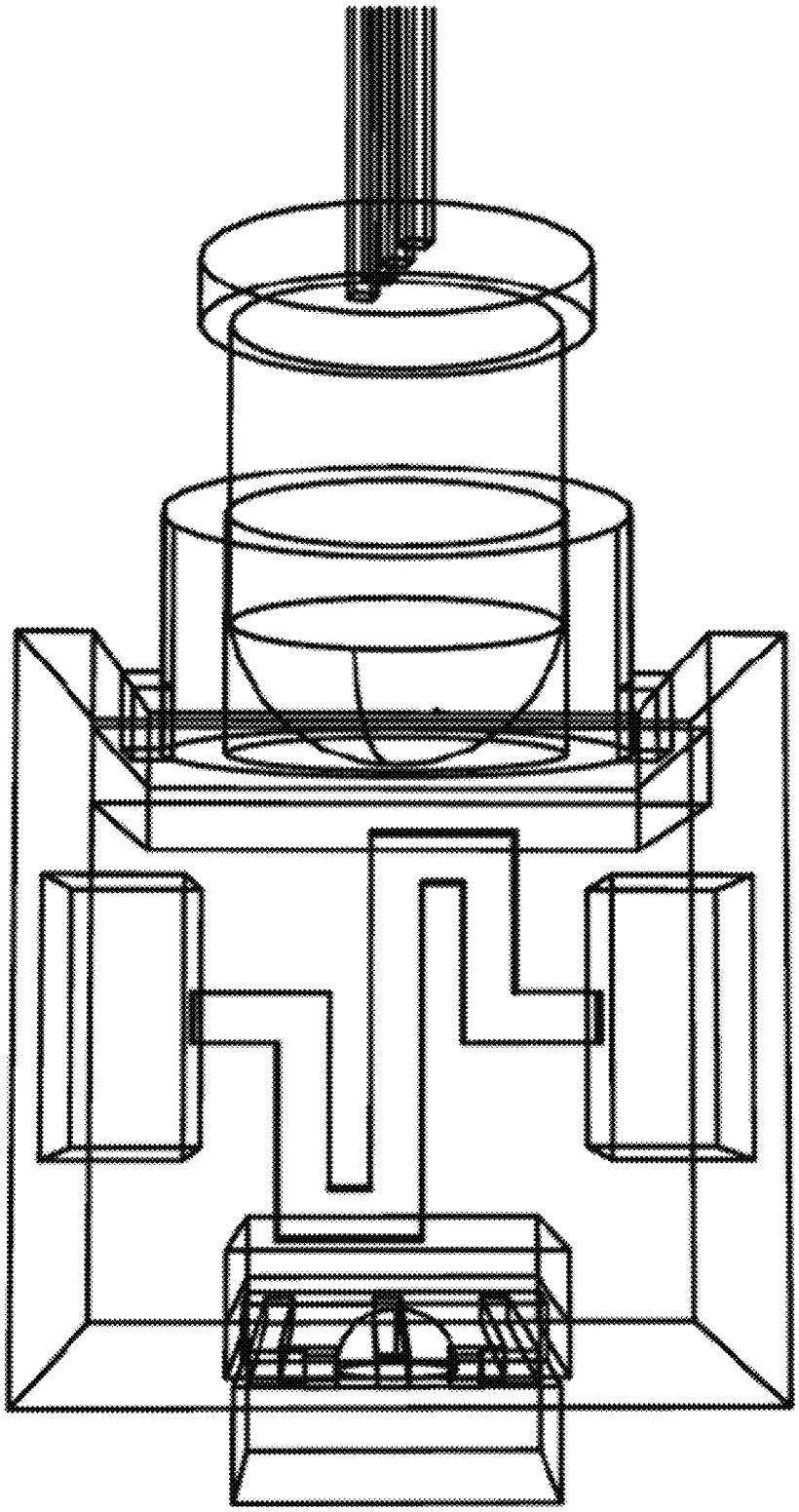
FIG. 17A illustrates an internal view of an exemplary optical sensor module where an LED is housed on the top surface of the module and a sensor is housed on the bottom surface of the module.

FIG. 17A illustrates an internal view of an exemplary optical sensor module where an LED is housed on the top surface of the module and a sensor is housed on the bottom surface of the module.

Figure 17B:
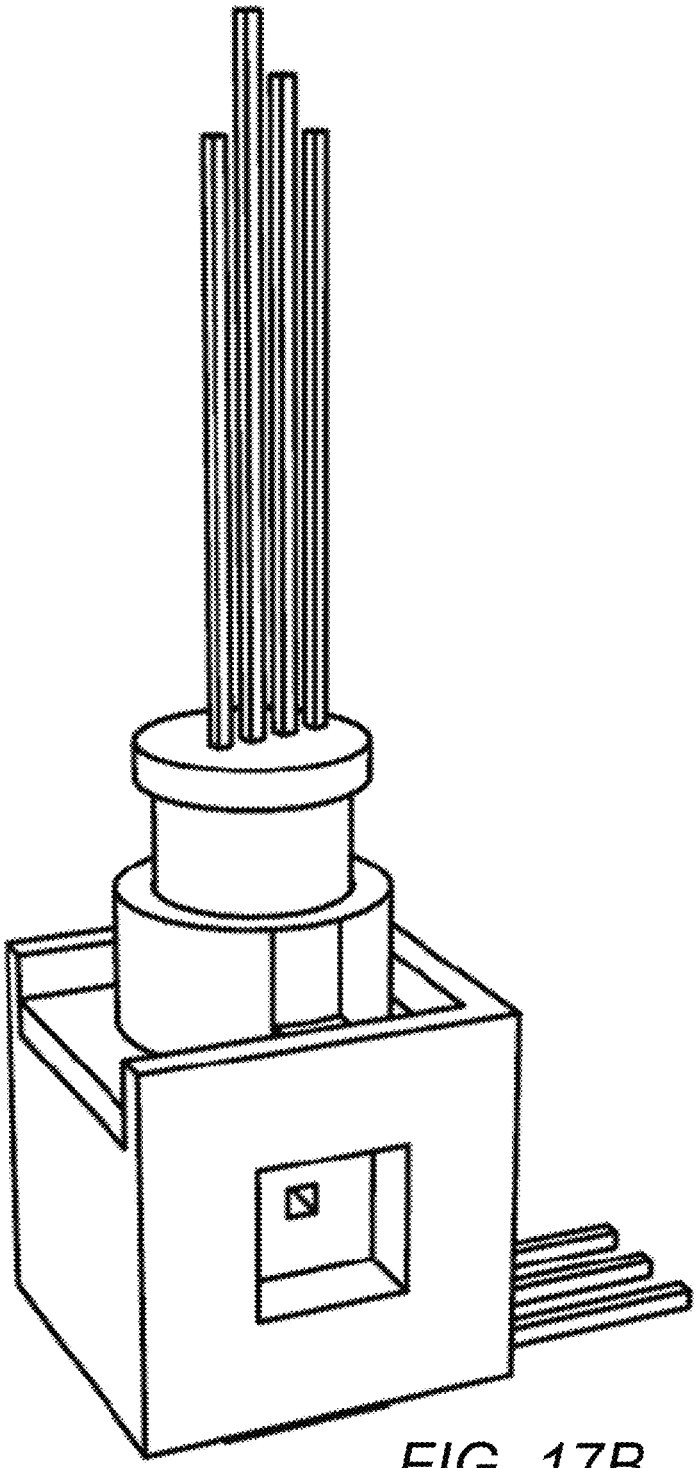
FIG. 17B illustrates an opaque external view of the exemplary optical sensor module of FIG. 17A.

FIG. 17B illustrates an opaque external view of the exemplary optical sensor module of FIG. 17A.

Figure 18:
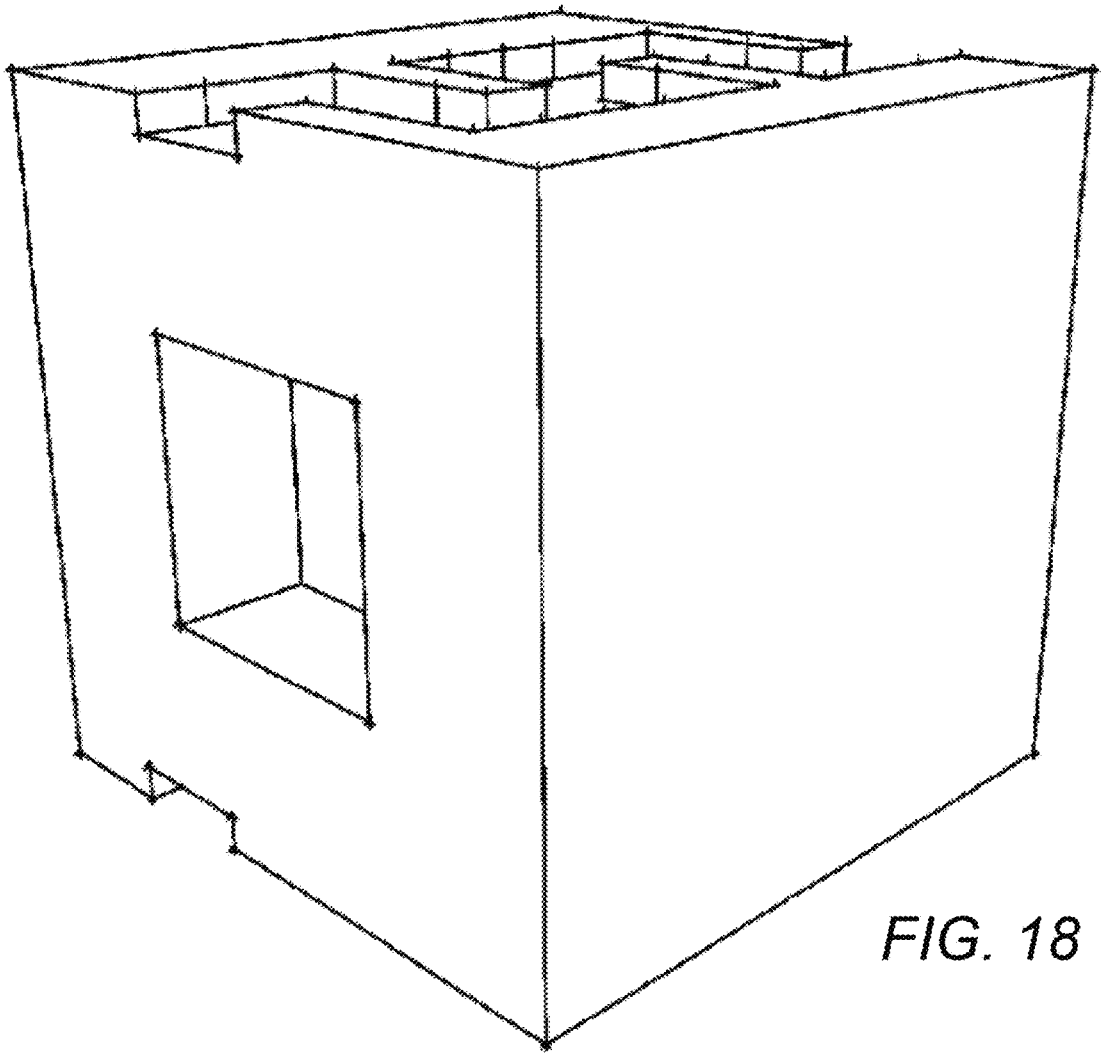
FIG. 18 illustrates an example of a mixer module with a visible opening on the front left side and a non-visible opening on the right-back side, and a visual indicator on the top surface.

FIG. 18 illustrates an example of a mixer module with a visible opening on the front left side and a non-visible opening on the right-back side, and a visual indicator on the top surface.

Figure 19:
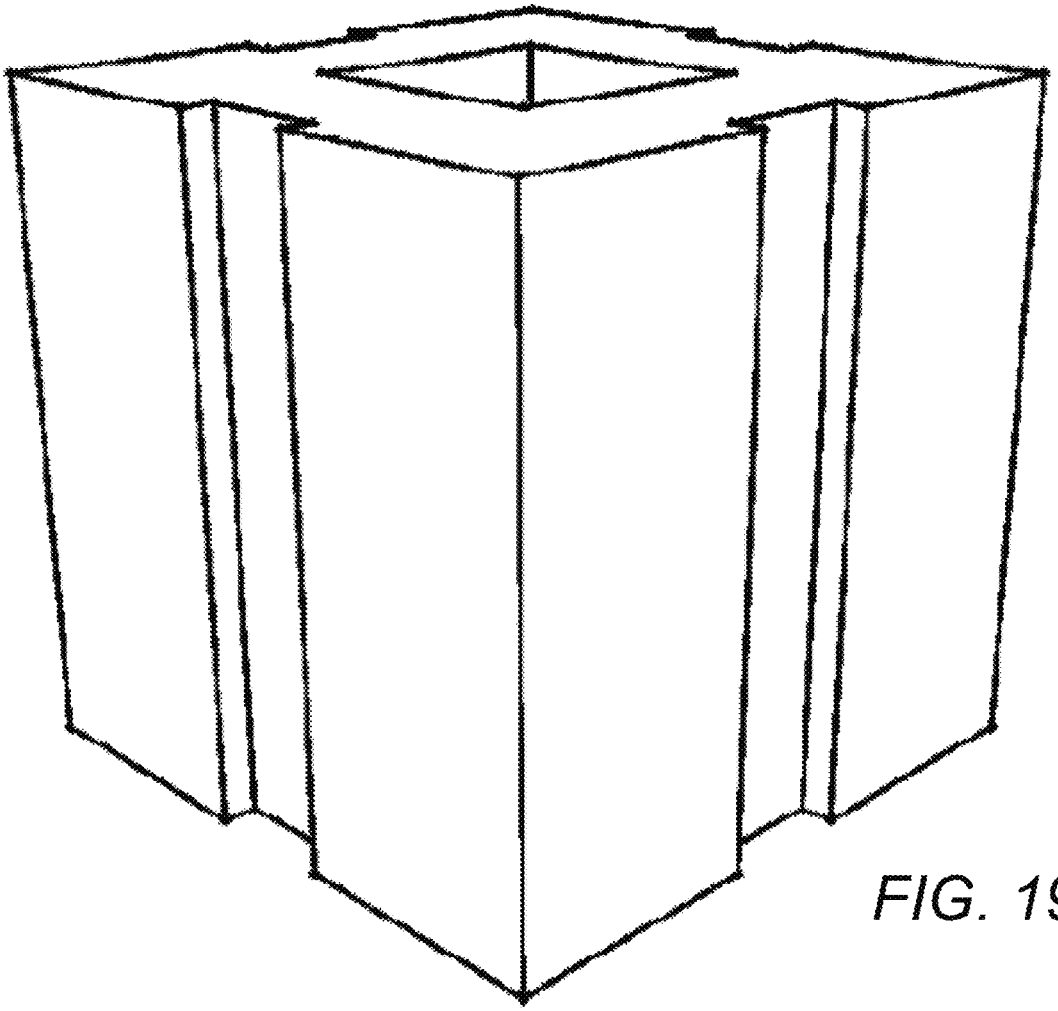
FIG. 19 illustrates an example of a straight-pass module with two openings at the top and at the bottom, and with a visual indicator present on several side surfaces of the module.

FIG. 19 illustrates an example of a straight-pass module with two openings at the top and at the bottom, and with a visual indicator present on several side surfaces of the module.

The modules, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different modules, steps, features, objects, benefits, and/or advantages. These also include embodiments in which the modules and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element preceded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any module, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

The invention claimed is:

1. A system for modular fluid handling, the system comprising:

a first module of a first three-dimensional polyhedral shape, the first module comprising a material and having an exterior with four or more faces;

a first opening on a first face of the four or more faces of the first module, wherein the first face is of a first polygonal shape;

a second opening on a second face of the four or more faces of the first module, wherein the second face is of the first polygonal shape;

a microfluidic channel passing through at least part of the first module and passing a fluid between at least the first opening and the second opening;

a light emitter embedded into the first module, wherein the light emitter emits light that intersects with the microfluidic channel while the microfluidic channel passes the fluid;

a receiver embedded into the first module, wherein the receiver receives the light emitted by the light emitter that intersects with the microfluidic channel, wherein a voltage signal from the receiver is indicative of a parameter of the fluid while the receiver receives the light that intersects with the microfluidic channel;

a first coupling mechanism on the first face of the first module, wherein the first module is connected to a second module of the first three-dimensional polyhedral shape via a first connector, the first coupling mechanism securing the first connector to the first face of the first module and allowing fluid flow between the first opening and the second module through the first connector; and a second coupling mechanism on the second face of the first module, wherein the first module is connected to a third module of the first three-dimensional polyhedral shape via a second connector, the second coupling mechanism securing the second connector to the second face of the first module and allowing fluid flow between the second opening and the third module through the second connector, wherein the fluid flows along at least one microfluidic flow path through each module and each connector of an assembly constructed using a plurality of modules and a plurality of connectors, the plurality of modules including at least the first module and the second module and the third module, the plurality of connectors including at least the first connector and the second connector, wherein the plurality of modules of the assembly are tiled in three dimensions within a three-dimensional regular polyhedral grid.

2. The system of claim 1, further comprising:

a microcontroller that identifies that the voltage signal from the receiver has reached at least a detection threshold voltage, indicating that a droplet of the fluid is of at least a particular length.

3. The system of claim 1, wherein the three-dimensional polyhedral grid is based on the first three-dimensional polyhedral shape, and wherein a subset of the plurality of modules of the assembly are secured in a polyhedral primitive cell arrangement based on the first three-dimensional polyhedral shape in which one of the subset of the plurality of modules is positioned at each corner of the polyhedral primitive cell arrangement.

4. The system of claim 1, wherein the receiver is a phototransistor.

5. The system of claim 1, wherein the parameter of the fluid is a length of a droplet of the fluid.

6. The system of claim 1, wherein the plurality of modules includes a magnet module having a magnet embedded therein that withdraws a magnetic bead from the fluid, wherein the magnetic bead is a substrate to a reagent.

7. The system of claim 1, further comprising a coating applied along an interior surface of the microfluidic channel via initiated chemical vapor deposition, wherein the coating modifies hydrophobicity of the interior surface of the microfluidic channel.

8. The system of claim 1, further comprising a microcontroller that digitizes the voltage signal from the receiver.

9. The system of claim 1, wherein a surface of the microfluidic channel includes a surface material that reacts with one or more chemicals in the fluid flowing through the microfluidic channel.

10. The system of claim 1, wherein the light that is emitted by the light emitter and received by the receiver is of one or more electromagnetic frequencies, wherein the one or more electromagnetic frequencies include at least one of an infrared (IR) frequency or a near-infrared (NIR) frequency.

11. The system of claim 1, wherein the parameter of the fluid is a droplet frequency of the fluid.

12. The system of claim 1, wherein the light emitter and the receiver are embedded into a stereo-lithographically fabricated part of the first module.

13. The system of claim 1, wherein the light emitter is embedded into one or more embossed features on a third face of the four or more faces of the first module, and wherein the receiver is embedded into one or more embossed features on a fourth face of the four or more faces of the first module.

14. A system for modular fluid handling, the system comprising:

a plurality of modules, wherein each module of the plurality of modules is of a first three-dimensional polyhedral shape, wherein each module of the plurality of modules comprises a material through which a microfluidic channel passes and carries fluid between a plurality of openings that are each on different faces of an exterior of the module, wherein one of the plurality of modules is an optical sensor module, a light emitter and a receiver embedded into the optical sensor module, wherein the light emitter emits light that passes through the microfluidic channel of the optical sensor module at least while the microfluidic channel of the optical sensor module carries the fluid, wherein the receiver receives the light and outputs a voltage signal that is indicative of a parameter of the fluid; and a plurality of connectors, wherein each connector of the plurality of connectors includes a second microfluidic channel, wherein each module of the plurality of modules is connected to at least one other module of the plurality of modules via one of the plurality of connectors so that the plurality of modules and the plurality of connectors are connected together into an assembly having at least one microfluidic flow path conveying the fluid through each module and each connector of the assembly, wherein the plurality of modules of the assembly are tiled in three dimensions within a three-dimensional polyhedral grid.

15. The system of claim 14, wherein the plurality of modules includes a thermal sensor module having a thermistor embedded therein, wherein the thermistor is in contact with the microfluidic channel of the thermal sensor module.

16. The system of claim 14, wherein at least a subset of the plurality of modules modulate a concentration of an ingredient within the fluid to a predetermined concentration.

17. The system of claim 14, wherein the plurality of modules of the assembly include at least one three-dimensional polyhedral primitive cell arrangement of modules.

18. A method of modular fluid handling, the method comprising:

receiving a fluid into a microfluidic flow path comprising a plurality of microfluidic channels that are connected to each other, wherein a first subset of the plurality of microfluidic channels are within a plurality of modules, wherein a remainder of the plurality of microfluidic channels other than the first subset are found in a plurality of connectors, wherein each module of the plurality of modules is of a first three-dimensional polyhedral shape, wherein each connector of the plurality of connectors is of a second shape, wherein each module of the plurality of modules is connected to at least one other module of the plurality of modules via one of the plurality of connectors so that the plurality of modules and the plurality of connectors are connected together into an assembly, the microfluidic flow path conveying the fluid through each module and each connector of the assembly, wherein the plurality of modules of the assembly are tiled in three dimensions within a three-dimensional polyhedral grid;

receiving the fluid into a first opening of the microfluidic channel of an optical sensor module of the plurality of modules while the fluid traverses the microfluidic flow path;

passing the fluid through the microfluidic channel of the optical sensor module to a second opening of the microfluidic channel of the optical sensor module;

emitting light from a light emitter embedded into the optical sensor module so that the light intersects with the microfluidic channel of the optical sensor module while the fluid passes through the microfluidic channel of the optical sensor module;

receiving the light via a receiver embedded into the optical sensor module; and outputting a voltage signal from the receiver in response to receiving the light via the receiver, wherein the voltage signal is indicative of a parameter of the fluid.

19. The method of claim 18, further comprising:

generating a digitized signal via a microcontroller associated with the first module by digitizing the voltage signal from the receiver; and transmitting the digitized signal from the microcontroller to a computing device, thereby conveying the parameter of the fluid to the computing device.

20. The method of claim 18, wherein the fluid is passed through the plurality of microfluidic channels on a scale of nano-liters or smaller, and further wherein flow of the fluid is laminar during passage of the fluid through at least a subset of the plurality of microfluidic channels.

21. The system of claim 1, wherein each connector of the plurality of connectors includes a first coupling module that secures to a coupling mechanism of one of the plurality of modules, a second coupling module that secures to a coupling mechanism of another of the plurality of modules, a spacer arranged between the first and second coupling modules and a connector channel passing the fluid between an opening along the first coupling module and an opening along the second coupling module.

* * * * *